US005710818A

United States Patent [19]

Yamato et al.

[11] Patent Number: 5,710,818

[45] Date of Patent: Jan. 20, 1998

[54] APPARATUS FOR EXPANDING AND CONTROLLING SOUND FIELDS

[75] Inventors: Toshitaka Yamato; Hiroshi Kowaki, both of Kobe; Kazuya Sako, Kakogawa; Hiroyuki Yamaguchi, Kobe, all of Japan

[73] Assignee: Fujitsu Ten Limited, Hyogo-ken, Japan

[21] Appl. No.: 188,738

[22] Filed: Jan. 31, 1994

Related U.S. Application Data

[63] Continuation of Ser. No. 786,847, Nov. 1, 1991, abandoned.

[30] Foreign Application Priority Data

| | | | |
|---|---|---|---|
| Nov. 1, 1990 | [JP] | Japan | 2-115813 U |
| Nov. 1, 1990 | [JP] | Japan | 2-115814 U |
| Nov. 8, 1990 | [JP] | Japan | 2-305707 |

[51] Int. Cl.[6] ..... H04S 1/00

[52] U.S. Cl. ..... 381/1; 381/86

[58] Field of Search ..... 381/1, 63, 86

[56] References Cited

U.S. PATENT DOCUMENTS

| | | | |
|---|---|---|---|
| 3,170,991 | 2/1965 | Glasgal . | |
| 4,121,059 | 10/1978 | Nakabayashi | 381/1 |
| 4,149,036 | 4/1979 | Okamoto et al. | 381/1 |
| 4,329,544 | 5/1982 | Yamada | 381/1 |
| 4,622,691 | 11/1986 | Tokumo et al. . | |
| 4,866,776 | 9/1989 | Kasai et al. . | |
| 4,953,219 | 8/1990 | Kasai et al. . | |
| 4,980,914 | 12/1990 | Kunugi et al. | 381/1 |
| 5,040,219 | 8/1991 | Ando et al. | 381/63 |
| 5,040,220 | 8/1991 | Iwamatsu | 381/63 |
| 5,068,897 | 11/1991 | Yamato et al. | 381/24 |
| 5,109,415 | 4/1992 | Ishida | 381/1 |
| 5,129,004 | 7/1992 | Imai et al. | 381/63 |

FOREIGN PATENT DOCUMENTS

| | | |
|---|---|---|
| 0 160 431 B1 | 4/1985 | European Pat. Off. . |
| 0 276 948 A2 | 1/1988 | European Pat. Off. . |
| 0 357 034 A2 | 8/1989 | European Pat. Off. . |
| 0 422 955 A2 | 10/1990 | European Pat. Off. . |
| 49-14104 | 2/1974 | Japan . |
| 53-139501 | 12/1978 | Japan . |
| 54-12702 | 1/1979 | Japan . |
| 58-41720 | 9/1983 | Japan . |
| 59-1040 | 1/1984 | Japan . |
| 61-257099 | 11/1986 | Japan . |
| 1-40560 | 8/1989 | Japan . |
| 2-161900 | 6/1990 | Japan . |
| 2-261300 | 10/1990 | Japan . |
| 4-72799 | 6/1992 | Japan . |
| 4-72800 | 6/1992 | Japan . |

OTHER PUBLICATIONS

Hans–Jaochim HAASE, 'Manipulationen zwischen Weidergabakanälen', *Funk–Technik*, 1986, magazine 12, pp. 526–530.

*Primary Examiner*—Forester W. Isen

*Attorney, Agent, or Firm*—Wenderoth, Lind & Ponack

[57] ABSTRACT

As in a compartment of an automotive vehicle, when a left- and a right-channel loudspeakers are disposed at angularly different positions from each other with respect to a frontward direction of a listening position, there will be formed a sound field laterally asymmetric with respect to the frontward direction of the listening position. In order to correct the asymmetry of the sound field, a crosstalk signal obtained by correcting the phase and the level of an acoustic signal of the left-channel from an acoustic signal source and a crosstalk adjustment signal obtained by correcting the level of the acoustic signal of the left-channel are fed to the right loudspeaker, or a center loudspeaker disposed between the left and right loudspeakers, together with an acoustic signal of the right-channel from the acoustic signal source. Similarly, a crosstalk signal obtained by correcting the phase and the level of an acoustic signal of the right-channel and a crosstalk adjustment signal obtained by correcting the level of the acoustic signal of the right-channel are fed to the left or center loudspeaker together with the acoustic signal of the left-channel from the acoustic signal source.

13 Claims, 16 Drawing Sheets

APPARATUS FOR EXPANDING AND CONTROLLING SOUND FIELDS

This application is a Continuation of now-abandoned application Ser. No. 07/786,847, filed Nov. 1, 1991.

BACKGROUND OF THE INVENTION

1. Field of the Invention

The present invention relates to an apparatus for expanding and controlling sound fields designed to correct the asymmetry of sound fields that will occur as in an automotive vehicle compartment when stereophonic signals are reproduced by loudspeakers disposed laterally asymmetrically with respect to a listening position, and to expand the sound fields for stereo-sound reproduction having a full presence.

2. Description of the Prior Art

FIG. 1(1) is a plan view for explaining asymmetric sound fields formed with in a vehicle compartment 51. In automotive stereo-sound reproducing apparatuses, a right-channel loudspeaker sr is disposed at a front right position of driver's seat 52, while a left-channel loudspeaker sl is disposed at a front left position of a passenger's seat 53 in the vehicle compartment 51 as shown in FIG. 1(1). These loudspeakers sl, sr are built in, for example, an instrument panel 54.

In a typical prior art arrangement, acoustic signals from an acoustic signal source are fed to the loudspeakers sl, sr with only right- and left-side balance thereof, i.e., level adjustment.

Therefore, focusing on the position of a driver 55 in FIG. 1(2), when sounds of equal energy level are released from the loudspeakers sl, sr, the acoustic energy distribution on the hearing sense of the driver 55 is not uniform between the left and right loudspeakers sl, sr and tends to be more biased toward the loudspeaker sr which is nearer to the driver 55.

Accordingly, the localization position of virtual sound source that should primarily be localized in the frontward direction of the driver 55 indicated by reference character l51 becomes biased toward the loudspeaker sr as indicated by reference character 57. Even when the balance of the acoustic signals is adjusted as described above, the acoustic energy distribution cannot be balanced between the right side and the left side, and therefore the angle of lateral divergence or bias of the sound fields cannot be corrected.

With prior art automotive stereo-sound reproducing apparatuses, thus, there is a problem in that the direction of localization of an sound image is deviated from the frontward direction of the listening position to form an asymmetrical sound image, which prevents the sound reproduction having full presence.

An approach toward solving the foregoing problem is disclosed in U.S. Pat. No. 4,866,776. According to this prior art disclosure, a center loudspeaker sc is disposed between loudspeakers sl, sr of left- and right-channels in an instrument panel 54. At the center loudspeaker sc, signals obtained by adding the acoustic signals of left- and right-channels are converted into acoustic vibrations.

With this arrangement, a sound field is formed by the right-channel loudspeaker sr and center loudspeaker sc at a right side seat 52 when viewed in the forward direction of vehicle compartment 51. On the other hand, a sound field is formed by the left-channel loudspeaker sl and center loudspeaker sc at a left side seat 53. In this way, a sound field that is relatively well balanced between the right- and left-channels are formed at both the right-side and left-side seats 52, 53.

In this prior art arrangement, however, the right-channel loudspeaker sr is disposed at an angle θ51 with respect to the frontward direction indicated by reference character l51, whereas the center loudspeaker sc is disposed at an angle θ52 with respect to the frontward direction l51, the angle θ52 being wider than the angle θ51. Therefore, the sound which the driver 55 listens to involves same deviation in phase as described above according to the difference in distance between the listening position of the driver 55 and the respective loudspeakers sr, sc.

Another problem comes from the fact that the compartment 51 is a limited acoustic space. Because of the limitation as to the mounting positions of the loudspeakers sl, sr, the angle of divergence shown by reference character θ51 is smaller than 30 degrees which can form an ideal sound field. More specifically, focusing on the position of the driver 55, the direction of the source of the right-channel sound cannot be localized outwardly of the loudspeaker sr disposed at a comparatively narrow angle of divergence. This results in a very narrow sound field, which provides no satisfactory sensation of presence.

Such a problem occurs likewise with a television receiver in which the right and left loudspeakers are narrowly spaced. When the viewer moves away from a screen of the television receiver to a location suitable for viewing the screen, the angle of divergence becomes narrower because of the narrowly spaced two loudspeakers, thus the viewer cannot enjoy good presence.

Another prior art arrangement intended to overcome this deficiency is disclosed in U.S. Pat. No. 4,953,219. In this prior art disclosure, a delay period or formation of reverberation sounds is selected on the basis of reverberation time within the vehicle compartment 51 that has been previously measured, thereby enabling reverberation sounds of a generally acceptable level to be produced so as to compensate for lack of presence.

However, with only reverberation sounds compensated, no wide distribution of fundamental sounds such as vocal sounds can be obtained. Thus, it is difficult to improve the sense of presence to any satisfactory extent.

Another prior art arrangement intended to solve the foregoing problem is disclosed in Japanese Examined Patent Publication JP 1-40560. According to this prior art arrangement, reverberation sounds are added. In addition, for example, with respect to the position of the driver 55, an acoustic signal of the right-channel generally to be outputted from the loudspeaker sr have the phase and level thereof adjusted, and adjusted acoustic signal is outputted from the left-channel loudspeaker sl. Thereby, some advantages results can be obtained which are equivalent to that obtainable in the case where the right-channel loudspeaker sr is disposed at a position indicated by reference character sra. In this way, an improved sense of presence has been achieved through expansion of sound fields and addition of reverberation sounds.

Generally, sound transmission characteristic vary greatly according to the frequency of the sound. Further, as particularly prominent in a vehicle compartment, sound transmission characteristics vary greatly according to the frequency of the sound. Accordingly, in adjusting the phase and the level of the acoustic signal, it is necessary that the acoustic signal is divided into a plurality of frequency bands, and adjusted amounts of the phase and level are set for the respective frequency bands.

However, the prior art stereo-sound reproducing apparatuses are so constructed that the respective adjusted amounts are changed individually to obtain an angle of divergence the listener will desire, necessitating a very cumbersome operation. Therefore, with particularly the automotive stereo-sound reproducing apparatuses, this cumbersome operation interferes with the driving operation.

Further, there has been proposed a stereo-sound reproducing apparatus In which effective sounds such as initial reflection sounds and reverberation sounds are added onto acoustic signals from a magnetic tape reproducing apparatus or a radio receiver, thereby enabling the acoustic sounds to be reproduced with full presence. Accordingly, even in this arrangement, a still further cumbersome operation is required to adjust the angle of divergence of the sound fields.

SUMMARY OF THE INVENTION

In consideration of the foregoing drawbacks of the prior arts, it is a primary object of the invention to provide a novel and improved apparatus for expanding and controlling sound fields, It is another object of the invention to provide an apparatus for expanding and controlling sound fields capable of forming wide and laterally symmetric sound fields by an easy operation and reproducing sounds with full presence.

In order to accomplish the above objects, the invention provides, an apparatus for expanding and controlling sound fields comprising:

an acoustic signal source for outputting acoustic signals of left- and right-channels means for correcting at least one of the phase and the, level of the acoustic signals of the left- and right-channels outputted from the acoustic signal source to generate crosstalk signals of the respective right- and left channels;

means for correcting the level of the acoustic signals of the left- and right-channels outputted iron the acoustic signal source to generate crosstalk adjustment signals of the respective right- and left-channels; and means for adding the crosstalk signals and the crosstalk adjustment signals of the left- and right-channels respectively to the corresponding acoustic signals of the left- and right-channels outputted from the acoustic signal source, and outputting the resultant signals to the corresponding left- and right- channel loudspeakers.

According to the invention, left- and right-channel loudspeakers used for stereo-sound reproduction are disposed as in an automotive vehicle compartment, at angularly different positions from each other with respect to a frontward direction of a listening position.

From an acoustic signal source, such as a magnetic tape reproducing apparatus and a radio receiver, acoustic signals of left- and right-channels are outputted. These acoustic signals are inputted to the crosstalk signal generating means and the crosstalk adjustment signal generating means.

The crosstalk signal generating means corrects at least one of the phase and the level of the acoustic signals of left- and right-channels inputted thereto so as to generate the crosstalk signals of the respective right- and left-channels. Also, the crosstalk adjustment signal generating means corrects the level of the acoustic signals of left- and right-channels inputted thereto so as to generate cross-talk adjustment signals of the respective right- and left-channels.

The corresponding crosstalk signals, crosstalk adjustment signals, and acoustic signals from the acoustic signal source are respectively added in the adding means, and outputted to the loudspeakers of the corresponding channels.

Accordingly, even at the listening position with respect to which the left and right loudspeakers are disposed at angularly different positions from each other, a laterally symmetric sound field can be formed in which a sound image is localized in a frontward direction of the listening position by adjusting the phase and the level correction amounts of the acoustic signals in the crosstalk signal generating means. Further, an angle of divergence of the sound field can be easily changed by adjusting the level correction amounts of the acoustic signals in the crosstalk adjustment signal generating means.

Further, a sound field for effective sounds relative to the fundamental sounds, such as initial reflection sounds and reverberation sounds, can have its lateral asymmetry corrected, and be expanded and controlled in a manner similar to the above, by treating the acoustic signals from the acoustic signal source as those of fundamental sounds. In this case, it may be appropriate that the crosstalk signal generating means and the crosstalk adjustment signal generating means for the effective sounds are additionally provided, and outputs of the corresponding channels from the respective generating means are released as sounds from a common loudspeaker after being added.

According to another aspect of the invention, there is provided an apparatus for expanding and controlling sound fields comprising:

an acoustic signal source for outputting acoustic signals of left- and right-channels to corresponding left- and right-channel loudspeakers;

means for correcting at least one of the phase and the level of the acoustic signals of the left- and right-channels outputted from the acoustic signal source to generate a crosstalk signal;

means for correcting the level of the acoustic signals of the left- and right-channels outputted from the acoustic signal source to generate a crosstalk adjustment signal; and means for adding the crosstalk signal and the crosstalk adjustment signal, and outputting the added signal to a center-channel loudspeaker disposed between the respective left- and right-channel loudspeakers.

Further, according to the invention, the acoustic signals of left- and right-channels from the acoustic signal source are outputted to the corresponding left- and right-channel loudspeakers, and also to the crosstalk signal generating means and the crosstalk adjustment signal generating means.

The crosstalk signal generating means corrects at least one of the phase and the level of the acoustic signals inputted thereto so as to generate the crosstalk signal. Further, the crosstalk adjustment signal generating means corrects the level of the acoustic signals inputted thereto so as to generate the crosstalk adjustment signal. The crosstalk signal and the crosstalk adjustment signal are added in the adding means, and outputted to the center-channel loudspeaker disposed between the left- and right-channel loudspeakers.

Thus, laterally symmetric sound fields can be formed which the respective sound images are localized in the frontward direction of left and right listening positions. In addition, by adjusting the level correction amount of the crosstalk adjustment signal, an ankle of divergence of the sound field can be easily adjusted.

Furthermore, it may be appropriate that acoustic signals of effective sounds are generated on the basis of the acoustic signals from the acoustic signal source, and released from the respective left- and right-channel loudspeakers in a manner similar to the above. Moreover, the crosstalk signal and the crosstalk adjustment signal may be generated from the acoustic signals of effective sounds, and be outputted from the center-channel loudspeaker.

BRIEF DESCRIPTION OF THE DRAWINGS

Other and further objects, features, and advantages of the invention will be more explicit from the following detailed description taken with reference to the drawings wherein:

FIG. 1(2) graphically shows an acoustic energy distribution on the hearing sense of a driver 55;

DETAILED DESCRIPTION OF THE PREFERRED EMBODIMENTS

Figure 1:
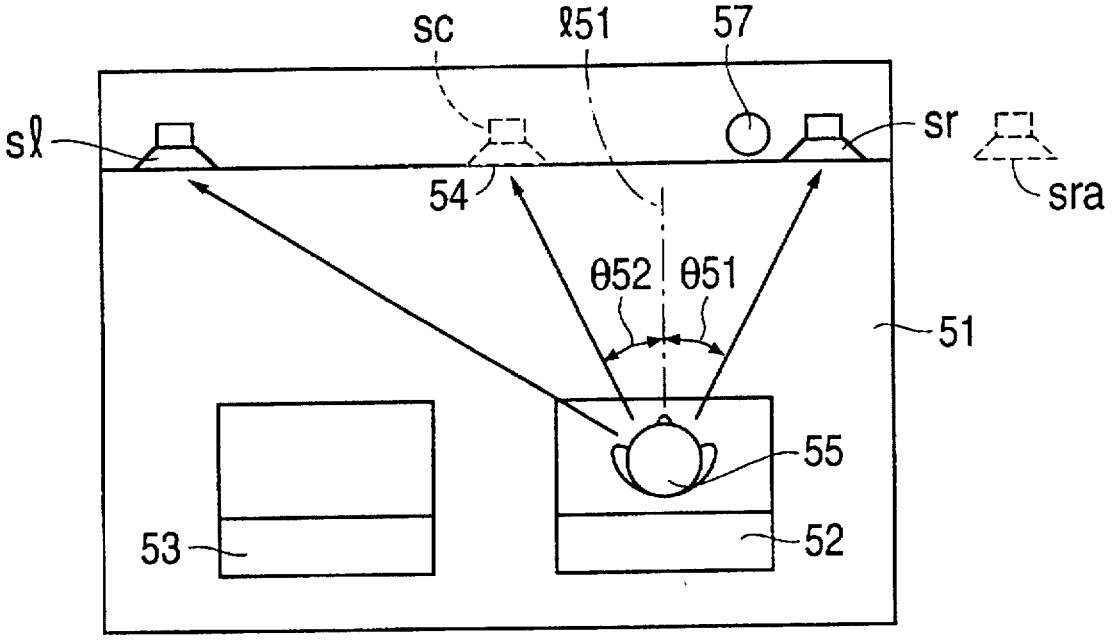
FIG. 1(1) PRIOR ART
FIG. 1(1) is a plan view for explaining the prior art.
Figure 1:
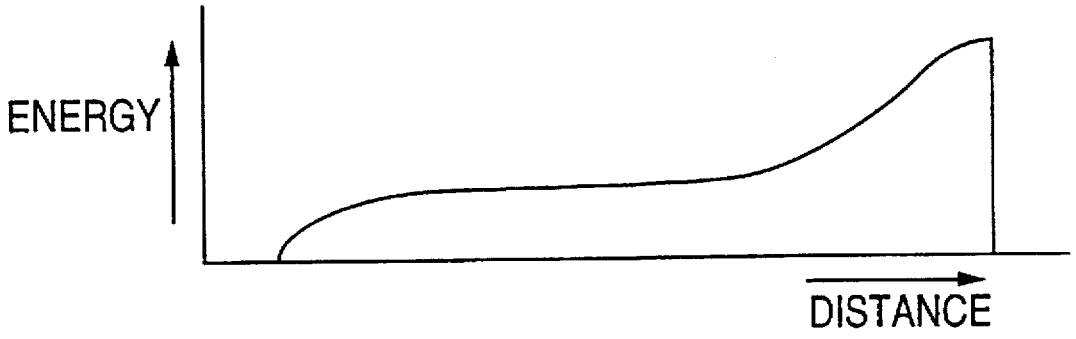
FIG. 1(2) PRIOR ART

Now referring to the drawings, preferred embodiments of the invention are described below.

Figure 2:
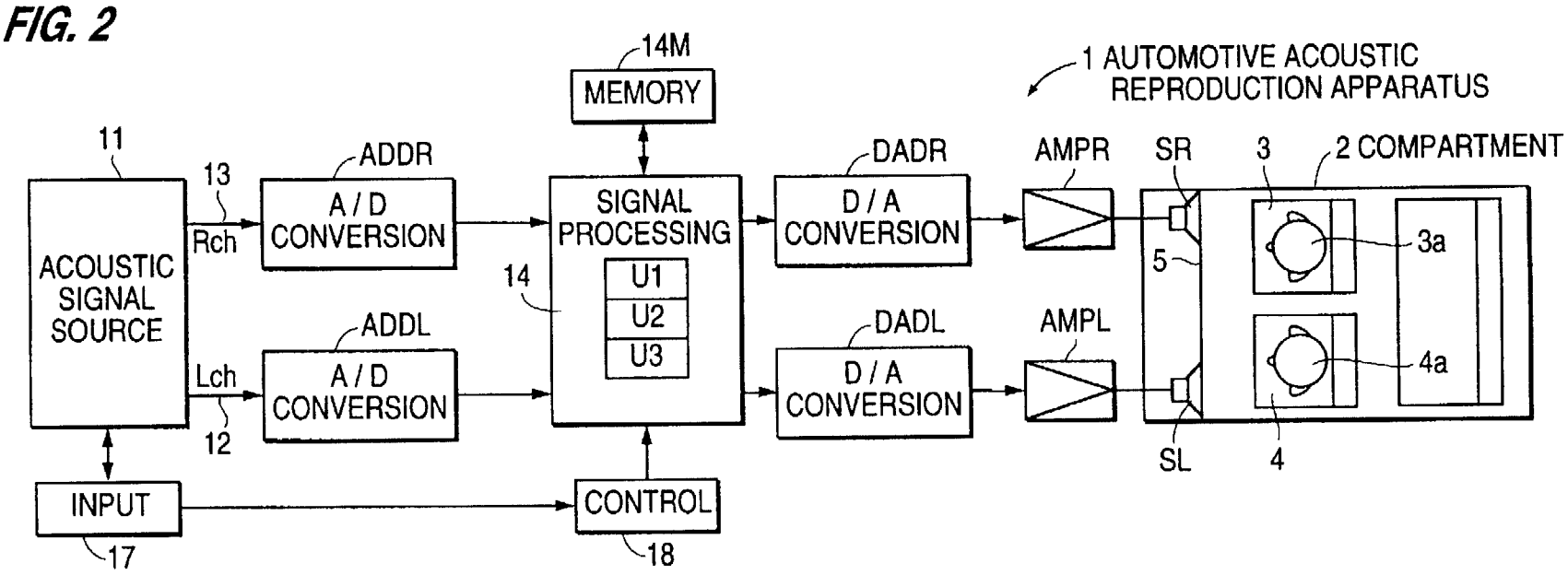
FIG. 2 is a block diagram showing an electric construction of an automotive acoustic reproducing apparatus 1 according to the invention.

FIG. 2 is a block diagram showing an electric construction of an automotive acoustic reproducing apparatus 1 as an embodiment of the invention. In a vehicle compartment 2, loudspeakers SL, SR are mounted on an instrument panel 5 disposed in front of a driver's seat 3 and a passenger's seat 4. More specifically, the loudspeaker SL is disposed on the left side while the loudspeaker SR is disposed on the right side with respect to a frontward direction from the driver's seat 3 and the assistant's seat 4.

An acoustic signal of left-channel is outputted to a line 12 while an acoustic signal of right-channel is outputted to a line 13 from an acoustic signal source 11, such as a magnetic tape reproducing apparatus, and a radio receiver. The acoustic signals of left- and right-channels are converted into digital acoustic signals respectively by analog/digital converters ADDL, ADDR, and then inputted to a signal processing unit 14.

The signal processing unit 14 may be a so-called digital signal processor or the like. A memory 14M is provided for the signal processing unit 14. Further, a control unit 18 is provided or controlling an arithmetic processing of the signal processing unit 14 in response to inputs from an input unit 17. The signal processing unit 14 carries out, for examples, delay processing with the use of the memory 14M in response to control signals sent from the control unit 18. The signal processing unit 14 corrects at least one of the phase and the level of the acoustic signals in such a manner as will be described later.

The digital acoustic signals of the left- and right-channels outputted from the signal processing unit 14 are converted into analog acoustic signals respectively by digital/analog converters DADL, DADR. The resultant analog acoustic signals are then outputted to the loudspeakers SL, SR through power amplifiers AMPL, AMPR corresponding to the respective digital/analog converters DADL, DADR, thereby to be released as sounds.

Figure 3:
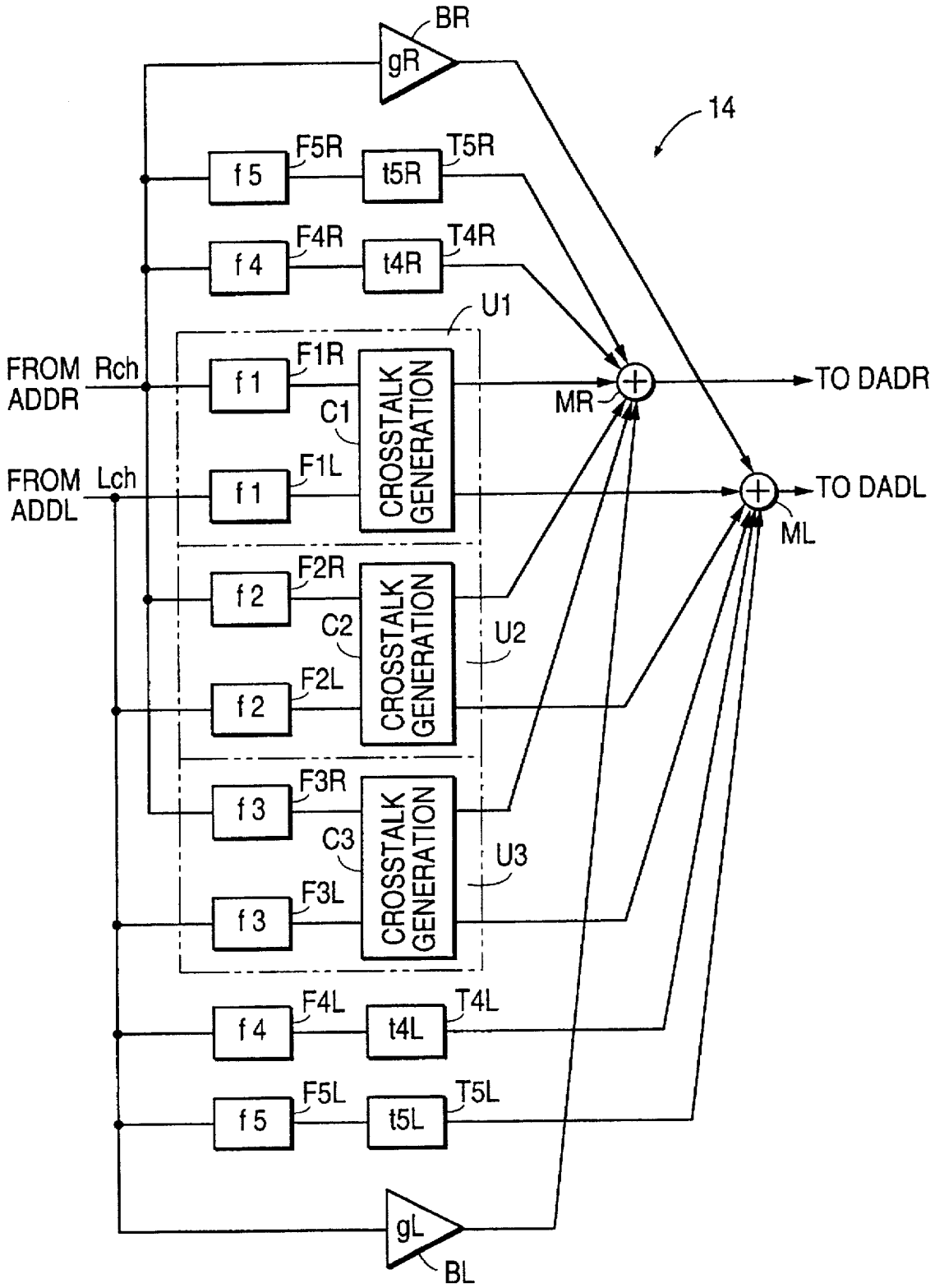
FIG. 3 is a functional block diagram for explaining signal processing operations of a signal processing unit 14.

FIG. 3 is a functional block diagram for explaining signal processing operations in the signal processing unit 14. The signal processing unit 14 comprises signal processing blocks including sound image control units U1 to U3, filter units F4L, F4R; FSL, FSR, delay units T4L, T4R; TSL, TSR, buffers BL, BR, and adder units ML, MR.

Generally, transmission characteristics of sounds vary according to the frequency bands thereof. For this reason, in order to equalize the phases of all frequency bands heard in the vicinity of the entrance of the external auditory channel of listeners 3*a*, 4 *a* at the driver's seat 3 and the passenger's seat 4, the acoustic signals are divided for each predetermined frequency band, and then corrected in the sound image control units U1 to U3.

Therefore, the left-channel acoustic signal inputted to the sound image control unit U1 is inputted to a bandpass filter unit (hereinafter referred to as BPF) F1L, in which signal components are filtered of the acoustic signal lying in a frequency band f1 to be subjected by the sound image control unit U1, for example, signal components of 200 to 400 Hz. An output of the BPF F1L is inputted to a crosstalk generating unit C1 to be described later. Similarly, the right-channel acoustic signal has signal components thereof lying in a frequency band f1 filtered in a BPF F1R, and then inputted to the crosstalk generating unit C1.

Similarly, in the sound image control unit U2, the left-channel acoustic signal is inputted to the crosstalk generating unit C2 after its signal components lying in a frequency ba d f2, e.g., those of 400 to 800 Hz, are filtered in a BPF F2L. The right-channel acoustic signal is inputted to the crosstalk generating unit C2 through a BPF F2R.

Further, in the sound image control unit U3, the left-channel acoustic signal of left-channel is inputted to the crosstalk generating unit C3 after its signal components lying in a frequency band f3, e.g., those of 800 to 1600 Hz, are filtered in a BPF F3L. The acoustic signal of the right-channel is inputted to the crosstalk generating unit C3 through a BPF F3R.

A part of the left-channel acoustic signal sent from the analog/digital converter ADDL is inputted through the high pass filter unit (hereinafter referred to as HPF) F4L or the low pass filter unit (hereinafter referred to as LPF) F5L to the delay units T4L, T5L respectively to be delayed by predetermined delay time t4L, t5L. Thereafter, the delayed signals are inputted to the adder unit ML. Further, a part of the left-channel acoustic signal of the entire frequency band is inputted to the adder unit MR as a crosstalk adjustment signal after being multiplied by a gain gL in the buffer BL.

Similarly, a part of the right-channel acoustic signal sent from the analog/digital converter ADDR is inputted through the HPF F4R, or LPF L5R to the delay units T4R, T5R to be delayed by predetermined delay time t4R, t5R. Subsequently, the delayed signals are inputted to the adder unit MR. Further, a part of the right-channel acoustic signal of the entire frequency band is inputted to the adder unit ML as a crosstalk adjustment signal after being multiplied by a gain gR in the buffer BR.

A cut-off frequency f4 of the HPF F4L, F4R is selected to, for example, 1600 Hz, and a cut-off frequency f5 of the LPF F5L, F5R is selected to for example 200 Hz.

Figure 4:
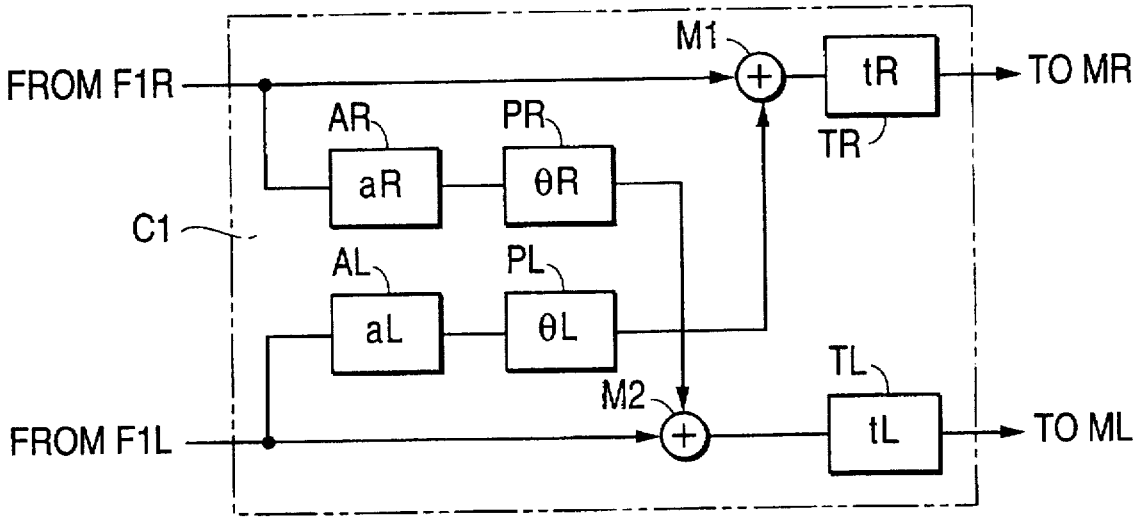
FIG. 4 is a functional block diagram for explaining in detail a crosstalk generating unit C1.

FIG. 4 is a functional block diagram for explaining in detail the crosstalk generating unit C1. A part of the output of the BPF F1L is inputted through an attenuator unit AL and a phase unit PL to an adder unit M1 as a crosstalk signal to be added to output from the BPF FIR. Outputs of the adder unit M1 are delayed by a predetermined delay time tR in a delay unit TR, and then outputted to the adder unit MR.

On the contrary, a part of output of the BPF F1R is inputted through an attenuator unit AR and a phase unit PR to the an adder unit M2 as a crosstalk signal to be added to output from the BPF F1L. Thereafter, the output of the adder unit M2 is delayed by a predetermined delay time tL in a delay unit TL, and then outputted to the adder unit ML. The phase units PL, PR correct the phase of the acoustic signal inputted thereto by θL, θR respectively. The attenuator units AL, AR attenuate the acoustic signal inputted thereto using attenuation factors aL, aR respectively. Constants, such as the phase correction amounts θL, θR and attenuation factors aL, aR, for digital signal processing are set by the control unit 18 in response to inputs from the input unit 17.

The remaining crosstalk generating units C2, C3 have a construction similar to the crosstalk generating unit C1 except that phase correction amounts θL, θR in the phase units PL, PR and attenuation factors aL, aR in the attenuator units AL, AR are set to values which vary in the respective frequency bands f1, f2, f3 in correspondence with acoustic characteristics of the compartment 2 in this embodiment.

Figure 5:
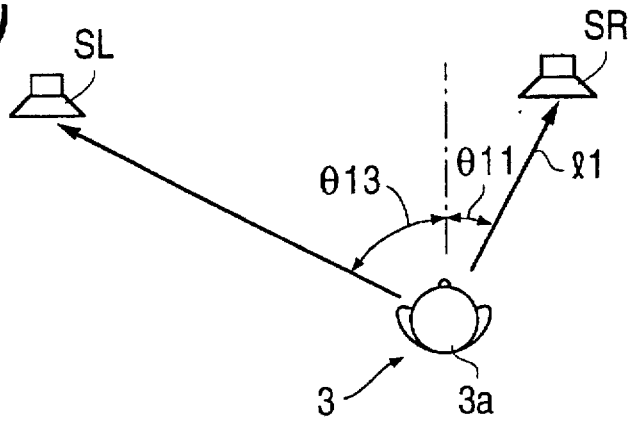
FIGS. 5(1) to 5(4) are plan views for explaining functions of sound image control units U1 to U3 respectively.
Figure 5:
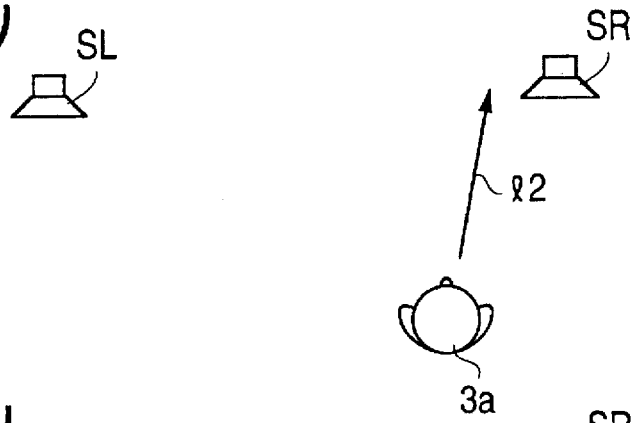
Figure 5:
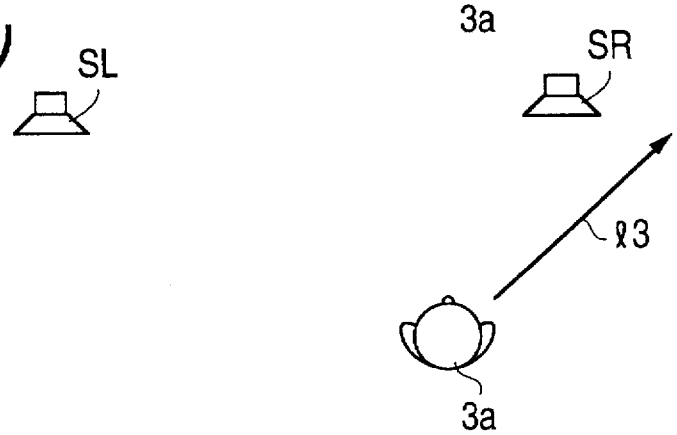
Figure 5:
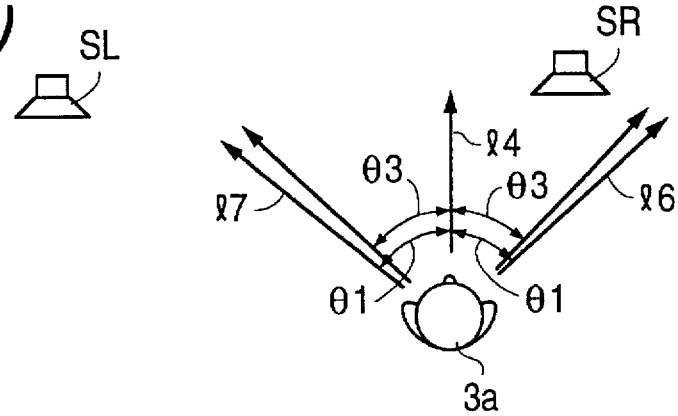

FIG. 5 is a plan view for explaining functions of the sound image control units U1 to U3, and buffers BL, BR. The loudspeaker SR is disposed to the right at an angle θ11 with respect to the frontward direction of the listener 3a seating in the driver's seat 3. The loudspeaker SL is disposed to the left at an angle θ13 greater than the angle θ11 with respect to the frontward direction of the listener 3a. In this state, when the right-channel sound is released only from the loudspeaker SR as shown in FIG. 5(1), the listener 3a perceives that source of the sound lies in a direction indicated by reference character l1.

When the same sound is released from the loudspeaker SL as well as he loudspeaker SR, the listener 3a perceives that the source of the sounds lies in a substantially frontward direction thereof indicated by reference character l2 in FIG. 5(2).

Thus, when the phase of the right-channel acoustic signal is corrected by the amount θR in the phase units PR and the level thereof are changed by the amount aR in attenuator units AR in the crosstalk generating unit C1 to C3, the listener 3a can perceive that the source of the right-channel sound lies in a direction outward of the loudspeaker SR as indicated by the reference character l3 in FIG. 5(3), instead of the previously perceived direction l2 which is inward of the loudspeaker SR.

In this state, when the left-channel sound by way of the phase units PL and the attenuator units AL is released from the loudspeaker SR while the left-channel sound by way of the BPFs F1L to F3L is released from the loudspeaker SL, a laterally symmetrical sound field can be formed such that the direction of sound image localization corresponds to the frontward direction of the listener 3a as indicated by reference character l4 and the sound field has an angle of divergence θ1 with respect to the frontward direction as indicated by reference characters l6, l7 as shown in FIG. 5(4).

The phase correction amounts θL, θR are adjusted so as to make the angle of divergence θ1 relatively large. In a state where the sound field indicated by reference character JRb in FIG. 6 which is laterally symmetrical and has a relatively large angle of divergence θ1 is thus formed, the gains gL, gR of the buffers BL, BR are adjusted to narrow the angle of divergence θ1. More specifically, the angle of divergence θ1 is narrowed by adjusting the level of the crosstalk adjustment signal; a signal to which the signal processing as described above is not applied. As a consequence, an ideal sound field as indicated by reference character JR in FIG. 6 can be obtained which has an ankle of divergence θ3, for example about 30 degrees.

As set forth above, according to this embodiment, an ideal sound field can be formed which is laterally symmetrical with respect to the driver's seat 3 as shown by reference character JR and has an ideal angle of divergence θ3, and thereby the sound image can be localized in the frontward direction of the listener 3a without deviation. Further, the angle of divergence θ3 can be adjusted by only effecting an easy operation of adjusting the gains gL, gR of the buffers BL, BR without changing parameters within the crosstalk generating unit C1 to C3, such as the phase correction amounts θL, θR. This contributes to a remarkable improvement in operability of the acoustic reproducing apparatus, and thereby reducing an adverse influence on the driving operation of the automotive vehicle.

Figure 7:
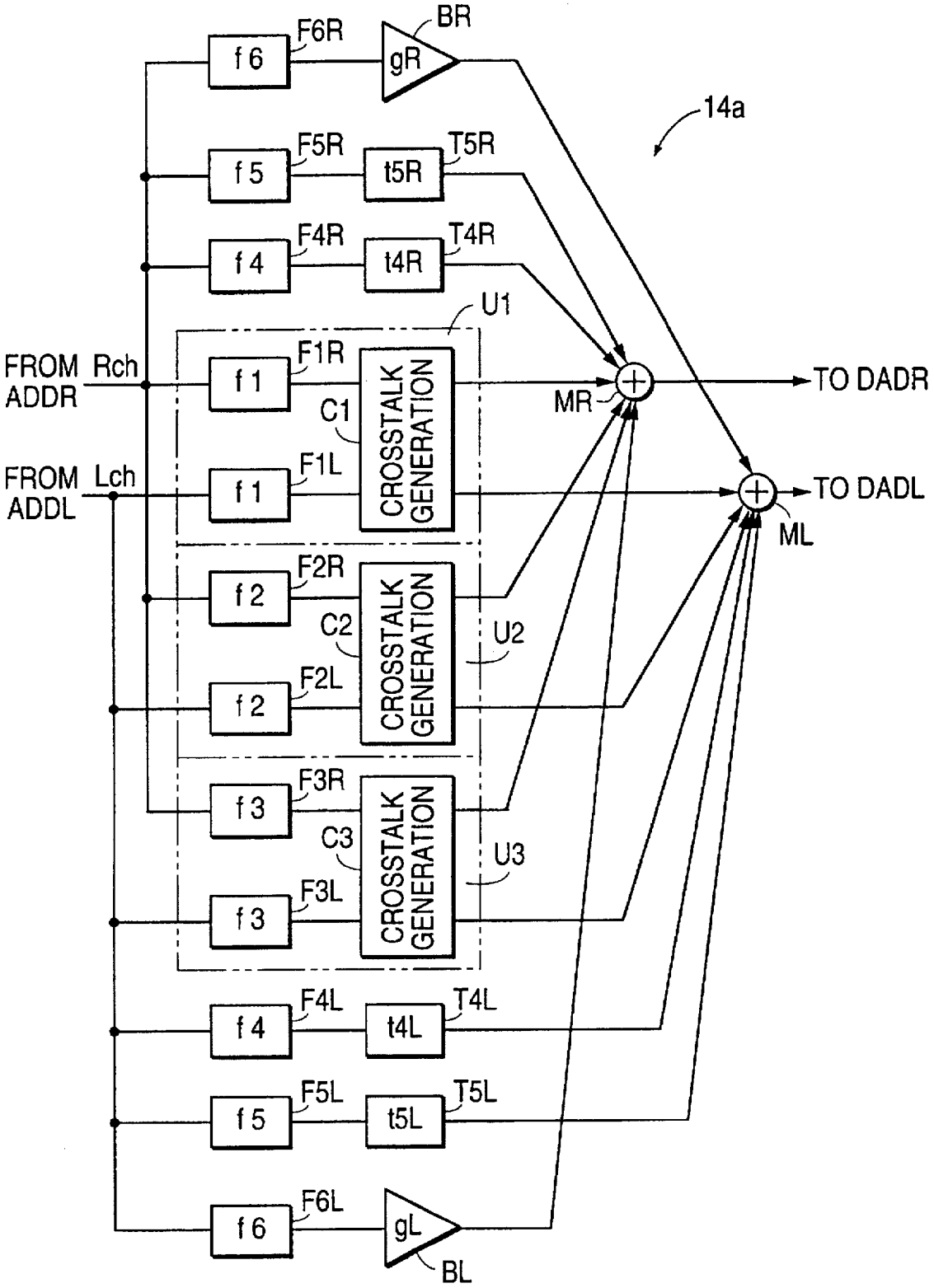
FIG. 7 is a functional block diagram for explaining a signal processing unit 14*a* of another embodiment of the invention.

In the foregoing embodiment, the acoustic signal of entire frequency bands from the acoustic signal source 11 is inputted to the buffers BL, BR. However, it may be appropriate to provide filters F6L, F6R to narrow the angle of divergence of the acoustic signals lying in a specific frequency band as in an acoustic signal processing unit 14*l* shown in FIG. 7 as another embodiment of the invention.

In this case, for example, LPFs of 3 kHz whose cut-off frequency is set at an upper limit of a frequency band of human voice may be used as filters F6L, F6R. Thereby, the vocal sound is made to form the sound field JR having the angle of divergence θ3, and the sound image of the vocal sound can be localized in the frontward direction of the listener 3a without deviation. The remaining acoustic components produced by musical instruments or the like may be made to form the sound field JRb having the angle of divergence θ1. Thus, a wider sound field can be formed than the sound field of the vocal sound.

In the foregoing embodiment, it is intended that optimum sound fields are formed with respect to the driver's seat 3. However, arrangement may be made to form optimum sound fields with respect to the passenger's seat 4 as another embodiment.

Figure 8:
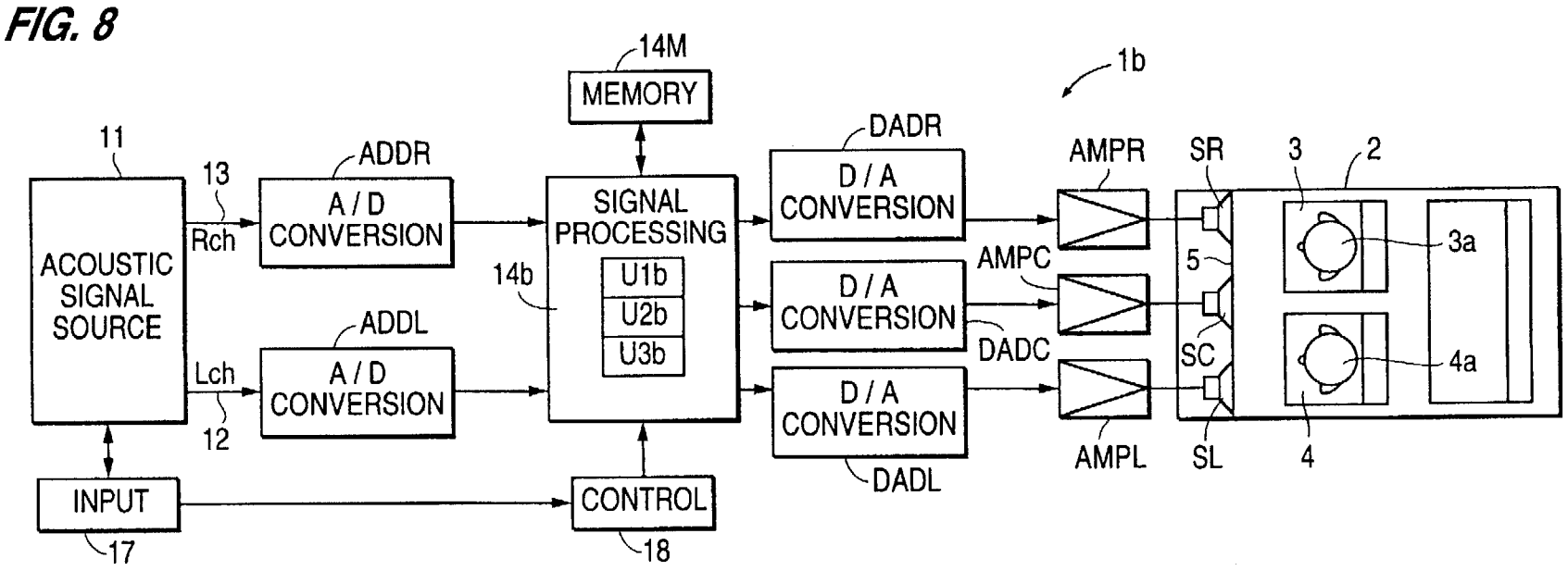
FIG. 8 is a block diagram showing an electric construction of an automotive acoustic reproducing apparatus 1*b* representing still another embodiment of the invention.
Figure 9:
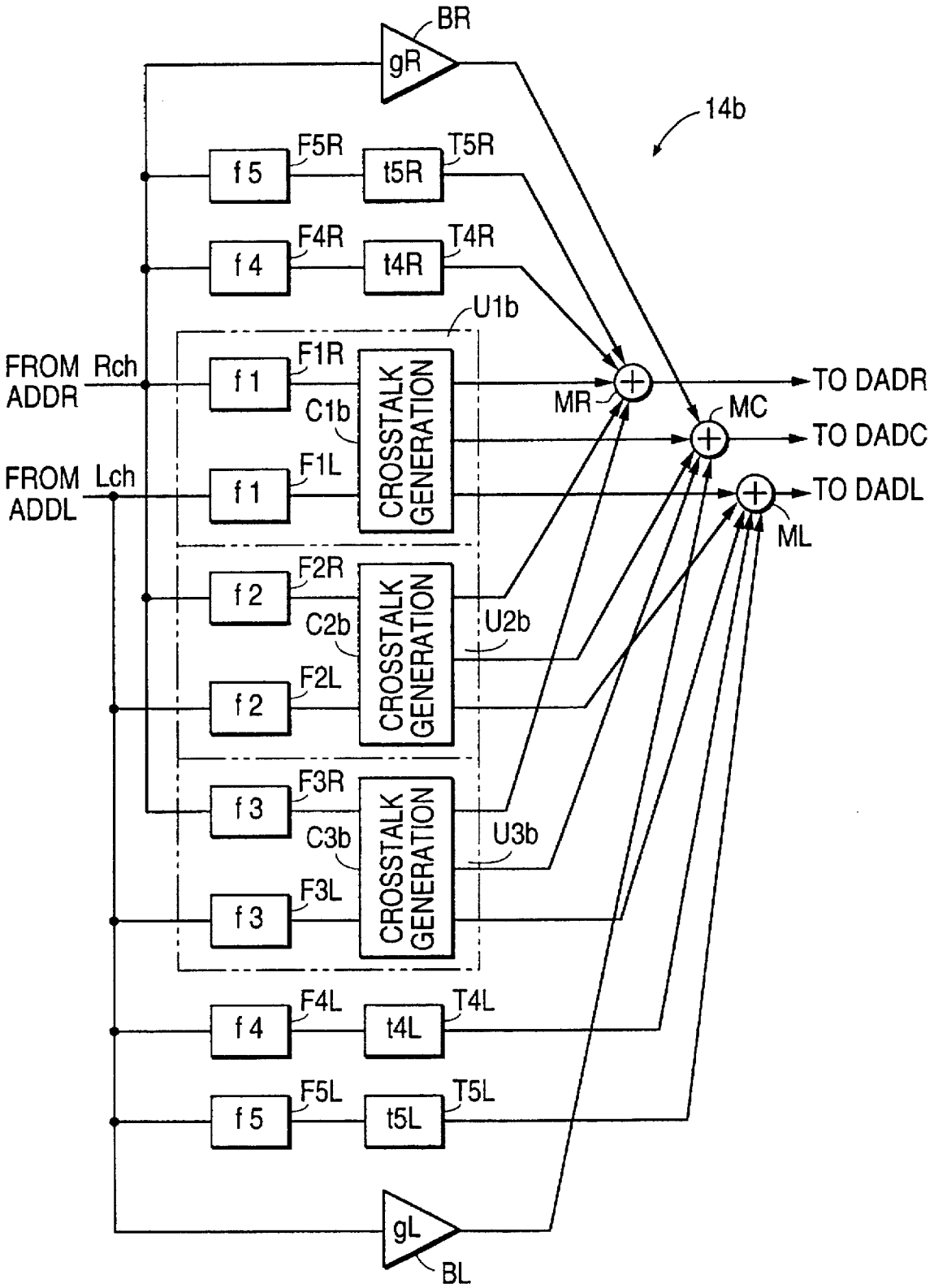
FIG. 9 is a functional block diagram for explaining signal processing operations in a signal processing unit 14*b;*
Figure 10:
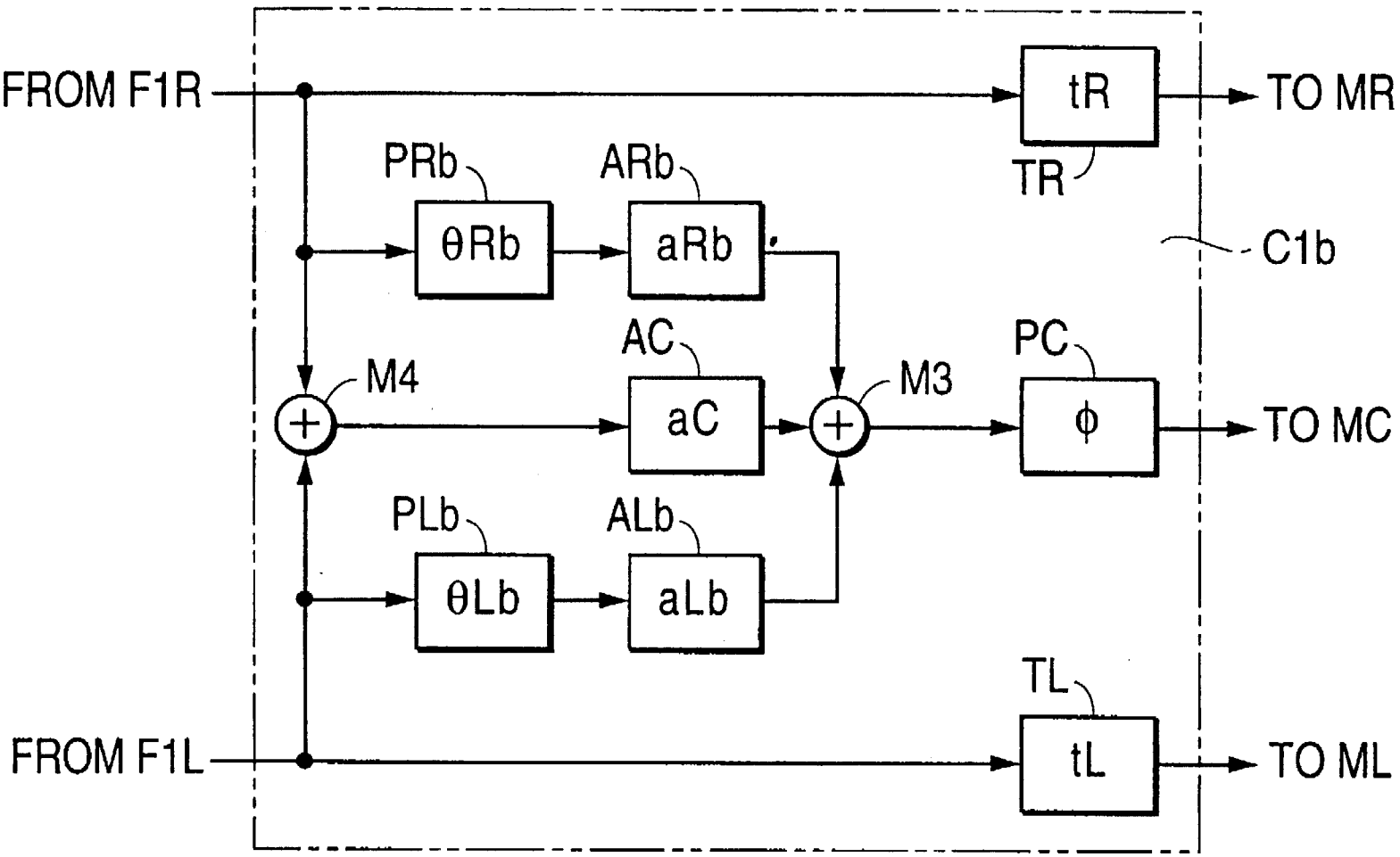
FIG. 10 is a functional block diagram for explaining in detail a crosstalk generating unit C1*b;*

FIG. 8 is a block diagram showing an electric construction of an automotive acoustic reproducing apparatus 1*b* representing still another embodiment of the invention; FIG. 9 is a functional block diagram for explaining signal processing operations in a signal processing unit 14*b*; and FIG. 10 is a functional block diagram for explaining in detail a crosstalk generating unit C1*b*. The embodiment is similar to the foregoing one, and therefore same or corresponding parts are indicated by like reference characters.

What should be taken notice of is that a center loudspeaker SC is provided between the left loudspeaker SL and the right loudspeaker SR in an instrument panel 5 in this embodiment. Accordingly, a power amplifier AMPC and a digital/analog converter DADC are provided in correspondence with the center loudspeaker SC. The signal processing unit 14*b* outputs acoustic signals of three channels, i.e., the left-, right-, and center-channels. The acoustic signal of the center-channel is fed to the center loudspeaker SC through the digital/analog converter DADC and the power amplifier AMPC.

In view of this, the crosstalk generating unit C1*b* of a sound image control unit U1*b* provided in the signal processing unit 14*b* is constructed as shown in FIG. 10. In this crosstalk generating unit C1*b*, outputs of BPFs F1L, F1R are inputted to an adder unit M3 through phase units PLb, PRb and attenuator units ALb, ARb respectively. Further, the acoustic signals of the left- and right-channels are added in an adder unit M4 in the crosstalk generating unit C1*b*. The added signal is inputted to the adder unit M3 after being attenuated by an attenuation factor aC in an attenuator unit AC. The output of the adder unit M3 is corrected in a phase unit PC by a phase correction amount $\phi$, and then outputted to an adder unit MC as a crosstalk signal.

Further, to the adder unit MC are inputted the crosstalk adjustment signals from the buffers BL, BR. The added output of the adder unit MC is fed to the digital/analog converter DADC.

Figure 11:
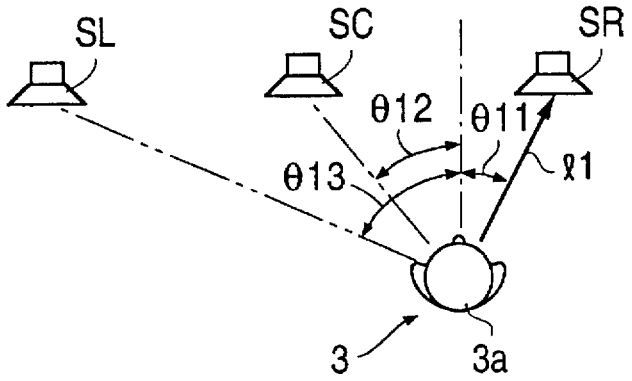
FIGS. 11(1) to 11(4) are plan views for explaining functions of sound image control units U1*b* to U3*b* respectively.
Figure 11:
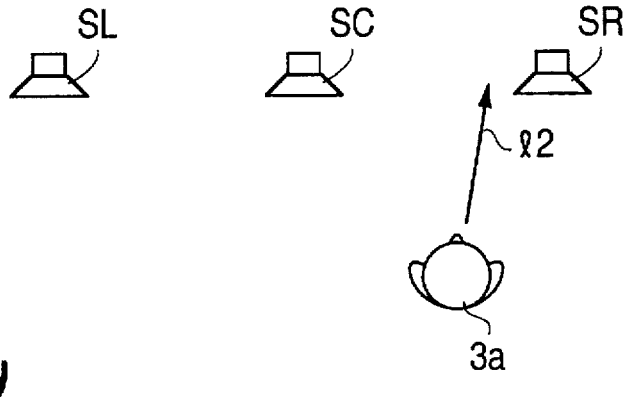
Figure 11:
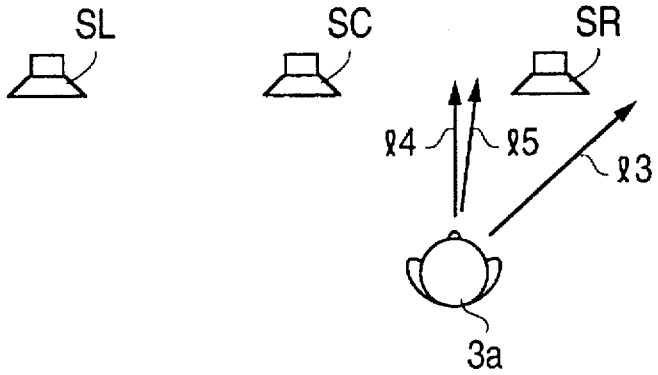
Figure 11:
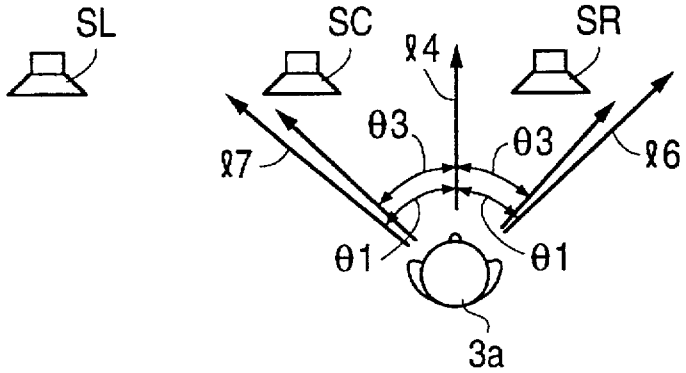

The remaining crosstalk generating units C2*b*, C3*b* are constructed similarly to the crosstalk generating unit C1*b*. However, phase correction factors $\theta$Lb, $\theta$Rb, $\phi$ in the phase units PLb, PRb, PC and attenuation factors aLb, aRb, aC in the attenuators ALb, ARb, AC are, in this embodiment, set to values which vary in the respective frequency bands f1, f2, f3 in correspondence with acoustic characteristics of the vehicle compartment 2. FIG. 11 is a plan view for explaining functions of sound image control units U1*b* to U3*b*, and buffers BL, BR. The right loudspeaker SR is disposed to the right at an ankle $\theta$11 with respect to the frontward direction of the listener 3*a* seating in the driver's seat 9. The center loudspeaker SC is disposed to the left at an angle $\theta$12 greater than the angle $\theta$11 with respect to the frontward direction of the listener 3*a*. The left loudspeaker SL is disposed further to the left at an angle $\theta$13 greater than the angle $\theta$12 with respect to the frontward direction of the listener 3*a*. In this state, when the right-channel sound is released only from the loudspeaker SR as shown in FIG. 11(1), the listener 3*a* perceives that the source of the sound lies in a direction indicated by reference character 11.

When the same sound is released from the center loudspeaker SC as well as the right loudspeaker SR, the listener 3*a* perceives that the source of the sounds lies in a substantially frontward direction thereof indicated by reference character 12 in FIG. (2).

Thus, when the phase of the right-channel acoustic signals are corrected by the amount $\theta$Rb In the phase units PRb and the level thereof are changed by the amount aRb in the attenuator units ARb of the crosstalk generating units C1*b* to C3*b*, the listener 3*a* can perceive that the source of the right-channel sound lies in a direction outward of the loudspeaker SR as indicated by the reference character 13 in FIG. 11(3), instead of the previously perceived direction 12. which is inward of the loudspeaker SR.

Figure 12:
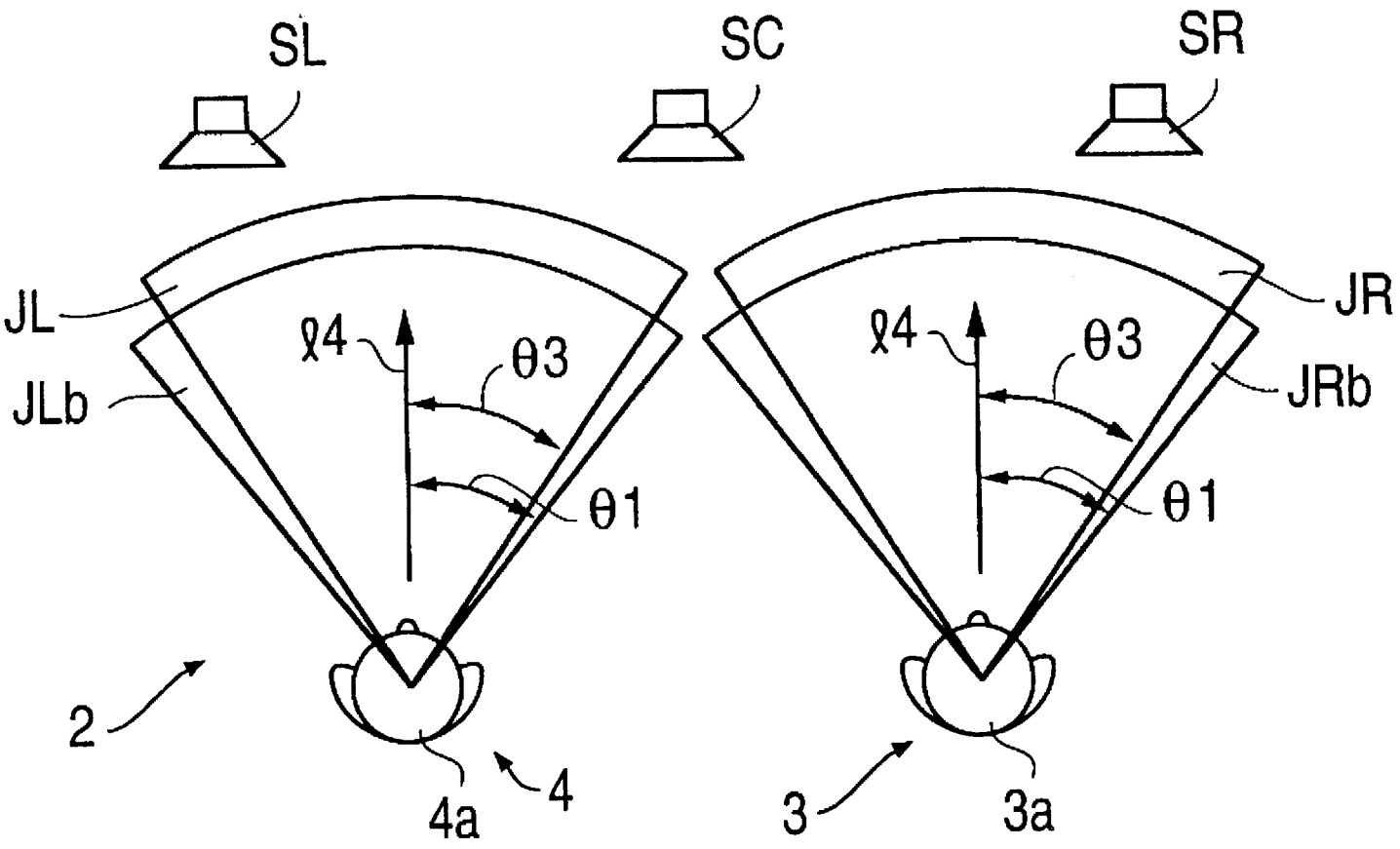
FIG. 12 is a plan view showing a widening effect of sound fields according to still another embodiment of the invention.

However, in this state, when the acoustic sound of the left channel through the phase units PLb is released from the center loudspeaker SC and the acoustic sound of the left-channel through the BPFs F1L to FSL is released from the left loudspeaker SL, the direction of localization of the sound image, which should be localized in the frontward direction of the listener 3*a* as indicated by reference character 14 in FIG. 11 (3) and FIG. 12, becomes biased toward the right loudspeaker SR as indicated by reference character 15. This is because the acoustic energy distribution on the hearing sense of the listener 3*a* becomes laterally asymmetrical.

The acoustic energy can be distributed laterally symmetrically by correcting the phase of the acoustic signal by the amount $\phi$ in the phase units PC. Accordingly, or laterally symmetrical sound field can be formed such that the sound image is localized in the frontward direction of the listener 3*a* as indicated by reference character 14 and the sound field has the angle of divergence $\theta$1 with respect to the frontward direction as indicated by reference character 16, 17 in FIG. 11(4).

The phase correction amounts $\theta$Lb, $\theta$Rb, $\phi$ are adjusted so as to make the angle of divergence $\theta$1 relatively large. In a state where the sound field indicated by reference character JRb in FIG. 12 is thus formed which is laterally symmetrical and has a relatively large angle of divergence. $\theta$1, the gains gL, gR of the buffers BL, BR are adjusted to narrow the angle of divergence $\theta$1. More specifically., the angle of divergence $\theta$1 is narrowed by adjusting the level of the crosstalk adjustment signal; a signal to which the signal processing as described above is not plied. As a consequence, an ideal sound field as indicated by reference character JR in FIG. 12 can be formed which has an angle of divergence of, for example, about 30 degrees. Similarly, a sound field having an ideal angle of divergence $\theta$3 and indicated by reference character JL can be formed with respect to the listener 4 *a* in the passenger's seat 4.

As set forth above, in this embodiment, the sound fields are formed as indicated by reference characters JR, JL which are laterally symmetrical and have an ideal angle of divergence $\theta$3 with respect to the driver's seat 3 and the assistant's seat 4, and thereby the sound image can be localized in the frontward direction of the listeners 3*a*, 4 *a* without deviation. Further, the angle of divergence $\theta$3 can be adjusted only by effecting an easy operation of adjusting the gains EL, gR of the buffers BL, BR without changing parameters within the crosstalk generating unit C1*b* to C3*b*, such as the phase correction amounts $\theta$Lb, $\theta$Rb, $\phi$.

Figure 13:
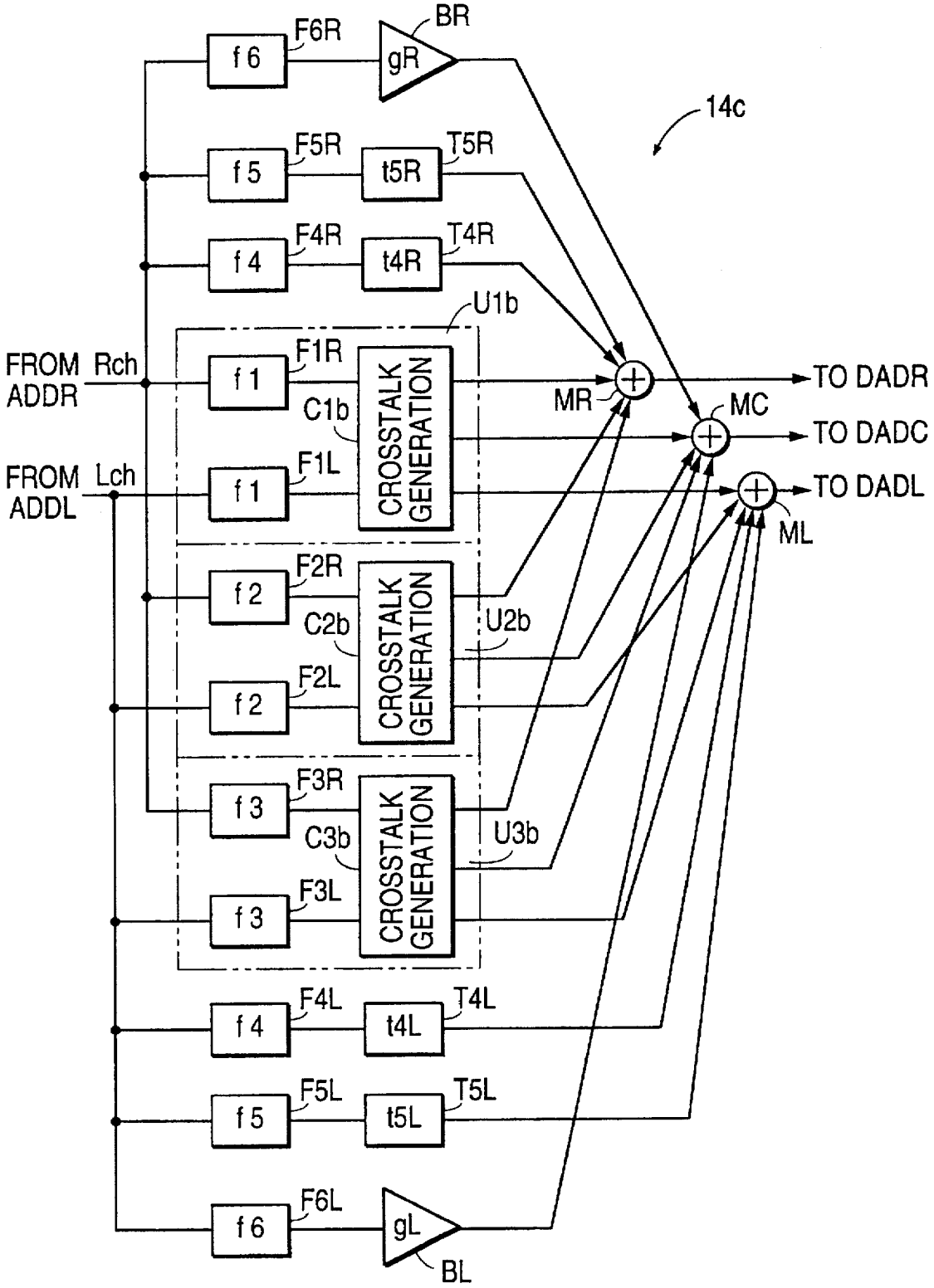
FIG. 13 is a functional block diagram for explaining a signal processing unit 14*c* of another embodiment of the invention.

In the foregoing embodiment, the acoustic signal of entire frequency bands from the acoustic signal source 11 is inputted to the buffers BL, BR. However, it may be appropriate to provide filters F6L, F6R as described above to narrow the angle of divergence of the acoustic signals lying in a specific frequency band as in an acoustic signal processing unit 14*c* shown in FIG. 13 as still another embodiment of the invention.

Figure 14:
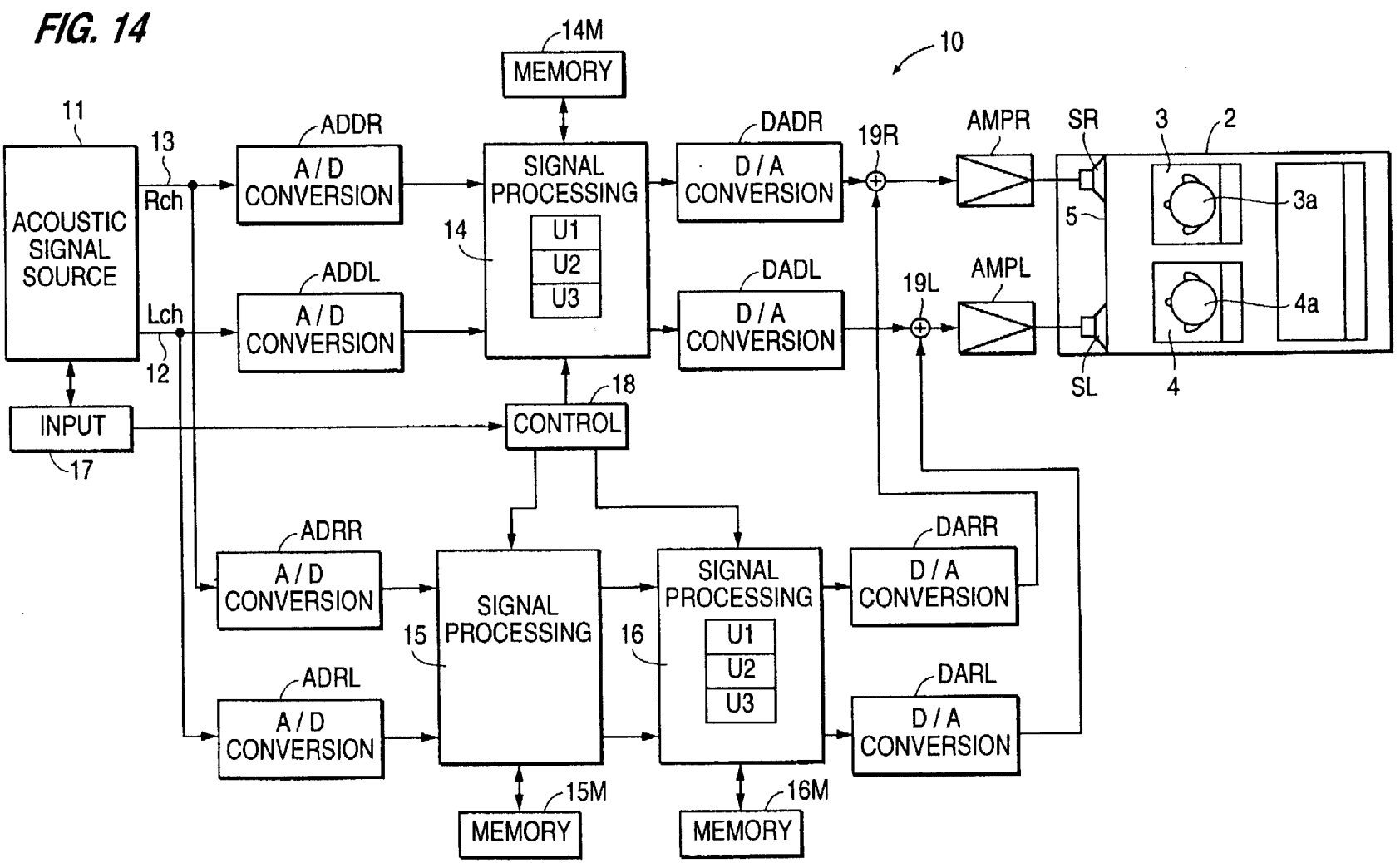
FIG. 14 is a block diagram shoving an electric construction of an automotive acoustic reproducing apparatus 10 representing still another embodiment according to the invention.
Figure 15:
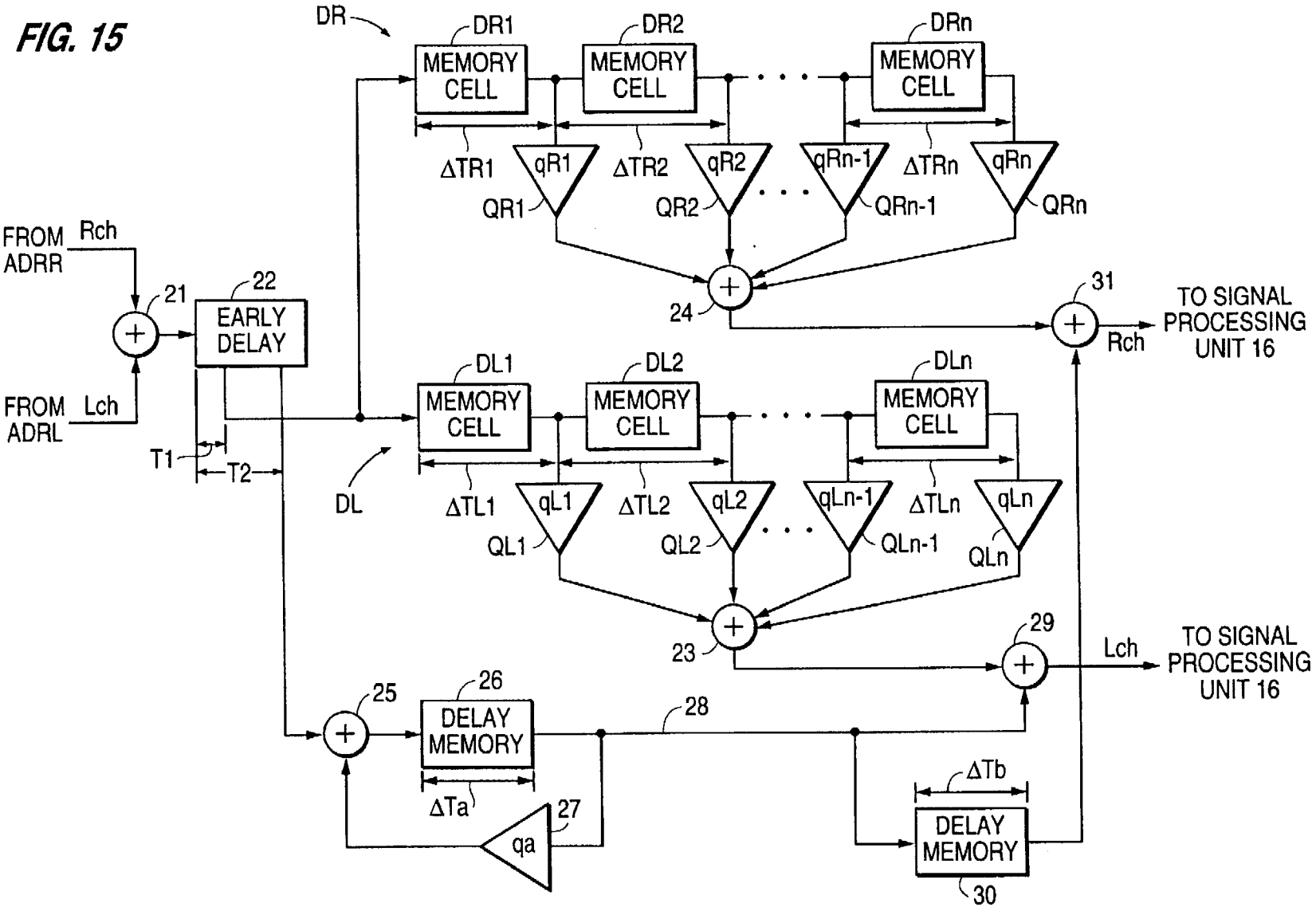
FIG. 15 is a functional block diagram for explaining a signal processing unit 15.

FIG. 14 is a block diagram showing an electric construction of an automotive acoustic reproducing apparatus 10 representing still another embodiment according to the invention. This embodiment is similar to the foregoing embodiments, and therefore same or corresponding parts are indicated by like reference characters. What should be taken notice of is that the acoustic signals from a sound signal source 11 are inputted to the signal processing unit 14 as acoustic signals of fundamental sounds. On the other hand, a signal processing unit 15, which may be a digital signal processor or the like, generates effective sounds such as initial reflection sounds and reverberation sounds in such a manner to be described below. Acoustic signals of the effective sounds are processed in a signal processing unit 16 having a construction similar to the signal processing unit 14, and then converted into acoustic vibrations together with those of the fundamental sounds sent from the signal processing unit 14.

More specifically, the acoustic signals of fundamental sounds of left- and right-channels from the acoustic signal source 11 are converted into digital acoustic signals in analog/digital converters ADRL, ADRR respectively, and then inputted to the signal processing unit 15. The signal processing unit 15 serving as means for generating the effective sounds processes the acoustic signals of fundamental sounds of the left- and right-channels inputted thereto so as to generate the acoustic signals of effective sounds of these channels, and outputs the resultant acoustic signals to the signal processing unit 16.

The digital acoustic signals of the left- and right-channels outputted from the signal processing unit 18 are converted into analog acoustic signals in digital/analog converters DARL, DARR, and then outputted to adder units 19L, 19R respectively. The analog acoustic signals of the left- and right-channels from the digital/analog converters DARL, DARR are added to the corresponding acoustic signals of fundamental sounds of the left- and right-channels from the signal processing unit 14 in the adder units 19L, 19R respectively. Thereafter, the added acoustic signals of the left- and right-channels are respectively inputted to the power amplifiers AMPL, AMPR. It will be noted that the signal processing units 18, 16 are provided with individual corresponding memories 15M, 16M, individually respectively, similar to the signal processing unit 14. These signal processing units 15, 16 execute arithmetic processings with the use of the memories 15M, 16M in response to control signals from the control unit 18.

Figure 16:
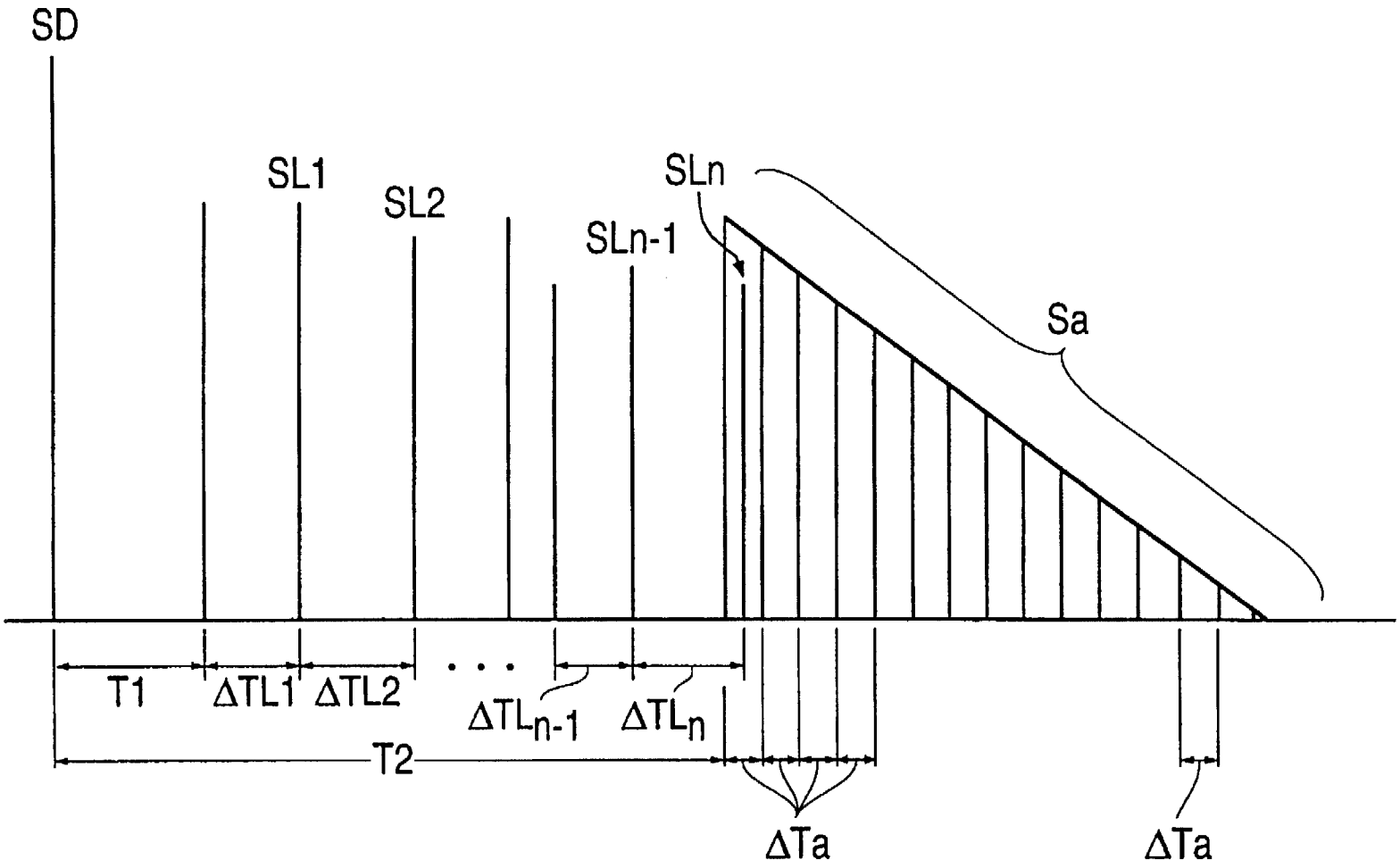
FIG. 16 is a graph showing acoustic spectra of fundamental sounds and effective sounds.

FIG. 16 is a functional block diagram of the signal processing unit 15. The acoustic signals of fundamental sounds of the left- and right-channels from the analog/digital converters ADRL, ADRR are added to be monaural acoustic signals in an adder unit 21, and then inputted to an early delay unit 22. The early delay unit 22 delays the monaural signals by a predetermined period of time T1 relative to the acoustic signals of fundamental sounds indicated by reference character SD in FIG. 16, and then outputs the same to delay memories DL, DR which are provided for the respective left- and right-channels.

The delay memory DL comprises a plurality of memory cells DL1, DL2, . . . , DLn. Individual memory cells DL1 DLn delay the acoustic signals inputted thereto by predetermined periods of time ΔTL1, ΔTL2, . . . , ΔTLn. Outputs of the respective memory cells DL1 to DL(n-1) are sent to the memory cells DL2 to DLn provided at next stages. Further, the outputs of the respective memory cells DL1 to DLn are sent through coefficient units QL1 to QLn to an adder unit 23 to be added therein. The coefficient units QL1 to QLn multiply the outputs from the corresponding memory cells DL1 to DLn by predetermined coefficients qL1 to qLn, and output the resultant signals to the adder unit 23.

A delay memory DR has a construction similar delay memory DL. In the delay memory DR, however, delay periods of the respective memory cells DR1 to DRn are selected to ΔTR1 to ΔTRn, and the coefficients in the respective coefficient units QR1 to QRn are selected to qR1 to qRn. Outputs of the respective coefficient units QR1 to QRn are sent to an adder unit 24 to be added therein.

The early delay unit 22 delays the monaural acoustic signal of fundamental sounds inputted thereto by a predetermined period of time T2, and then outputs the delayed signals to an adder unit 25. The output of the adder unit 25 is delayed in a delay memory 28 by a predetermined period of time ΔTa, which is relatively short, and then outputted to a line 28. The output of the delay memory 26 is multiplied by a coefficient qa in a coefficient unit 27, and fed back to the adder unit 25.

The output of the delay memory 26 is sent through the line 28 to an adder unit 29 to be added to the output from the adder unit 23, and then fed to the signal processing unit 18 as an acoustic signal of effective sounds of the left-channel. The output of the delay memory 26 is also sent to a delay memory 30 to be delayed by a predetermined period of time ΔTb therein, and then sent to an adder unit 31. In the adder unit 31, the delayed output is added to the output from the adder unit 24, and consequently fed to the signal processing unit 16 as an acoustic signal of effective sounds of the right-channel.

Accordingly, in consideration of only the left-channel, as shown in FIG. 16, a first initial reflection sound indicated by reference character SL1 is formed from a fundamental sound indicated by reference character SD after a period ΔT1+ΔTL1. Thereafter, initial reflection sounds SL2, SL3, . . . , SLn are respectively formed in succession after periods ΔTL2, ΔTL3, . . . , ΔTLn. The levels of the reflection sounds SL1 to SLn are determined by the coefficients qL1 to qLn respectively. The respective reflection sounds SL1 to SLn correspond to a plurality of reflection paths of sounds reflected from surfaces, such as ceiling, walls, and floor, which define an acoustic space.

Following the lapse of a time period T2 after the fundamental sound SD is released, there will be formed reverberation sounds Sa which are attenuated by factor qa for each time period ΔTa. Similarly, for the right-channel, there will be formed initial reflection sounds for each of time periods ΔTR1 to ΔTRn and reverberation sounds Sa which are behind that of the left-channel by the time period ΔTb.

The time periods T1, T2: ΔTL1 to ΔTLn: ΔTR1 to ΔTRn: ΔTa, ΔTb, and the coefficients QL1 to qLn qR1 to qRn: qa are, similar to the phase correction amount θL, θR and attenuation factors aL, aR, set by the control unit 18 in response to the inputs from the input unit 17. By changing such constants for digital signal processing, it is possible to simulate acoustic characteristics of a concert hall or baseball stadium.

Figure 6:
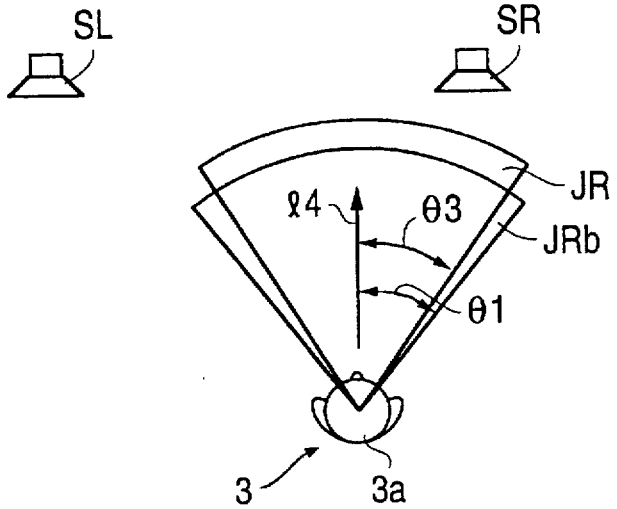
FIG. 6 is a plan view showing a widening effect of sound fields according to the invention.

Therefore, in the case where the gains gL, gR of the buffers BL, BR are made smaller in the sound image control units U1 to U3 of the signal processing unit 16 to reduce the level of the crosstalk adjustment signal, there will be formed a relatively wide sound field for effective sounds as indicated by reference character JRb in FIG. 6.

Further, in the case where the gains gL, gR of the buffers BL, BR are made larger, compared to those in the signal processing unit 16, in the control units U1 to U3 of the signal processing unit 14 to enhance the level of the crosstalk adjustment signal, there will be formed a sound field for fundamental sounds as indicated by reference character JR in which the sound image is stably localized in the frontward direction of the listener and which is laterally symmetrical.

By controlling the sound field JR for fundamental sounds and the sound field JRb for effective sounds individually in this way, the sound image can be localized in the frontward direction of the listener and sounds can be reproduced with full presence.

Figure 17:
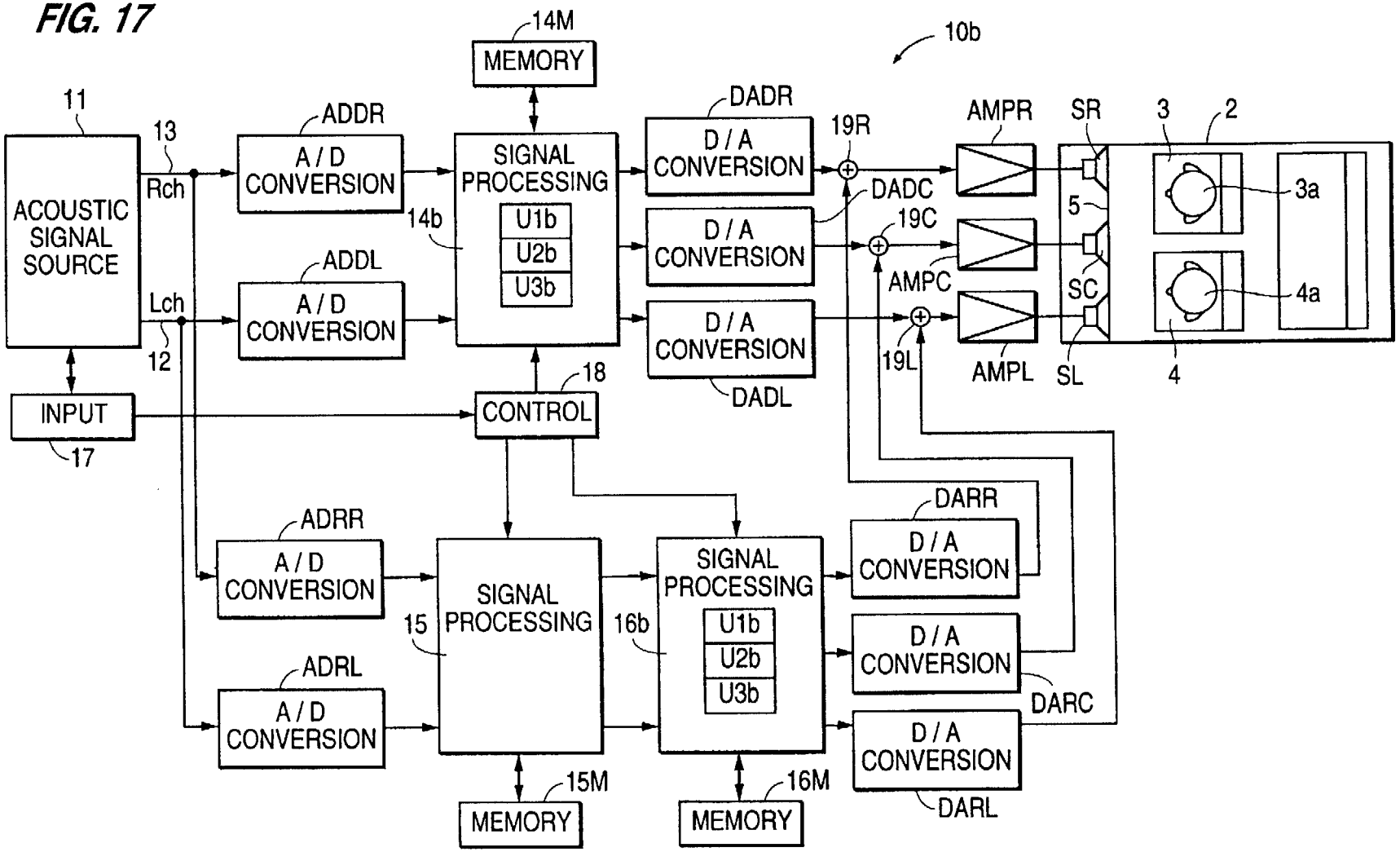
FIG. 17 is a block diagram showing an electric construction of an automotive acoustic reproducing apparatus 10*b* representing still another embodiment according to the invention.

FIG. 17 is a block diagram showing an electric construction of an automotive acoustic reproducing apparatus **10*b* representing another embodiment of the invention. This embodiment is similar to the foregoing embodiments shown in FIGS. 8 and 14, and therefore same or corresponding parts are indicated by like reference characters. What should be of notice is that fundamental sounds and effective sounds are released from a center loudspeaker in this embodiment. Accordingly, a digital acoustic signal of fundamental sounds of the center-channel from the signal processing unit 14*b* is converted into analog acoustic signals in a digital/analog converter DADC, and then inputted to an adder unit 19C. A digital acoustic signal of effective sounds of the center-channel from a signal processing unit 16*b* is converted into analog acoustic signals in a digital/analog converter DARC, and then inputted to the adder unit 19C. The acoustic signal from the adder unit 19C is amplified in a power amplifier AMPC, and then fed to the center loudspeaker Therefore, in the case where the gains gL, gR of buffers BL, BE are made smaller in the signal processing unit 16*b* to reduce the level of the crosstalk adjustment signal, there will be formed relatively wide sound fields for effective sounds with respect to listeners as indicated by reference characters JLb, JRb in FIG. 12. Further in the case where the gains gL, gR of the buffers BL, BE are made larger in the signal processing unit 14*b* to enhance the level of the crosstalk adjustment signal, there will be formed sound fields for fundamental sounds as indicated by reference character JL, JR in FIG. 12** in which the sound image is stably localized in the frontward direction of the listener and which is laterally symmetrical in this way, the sound fields for fundamental sounds and those for effective sounds can be easily individually controlled so as to have a desired expanse individually respectively.

Correction for a laterally asymmetric sound field and control for expanding the sound field as described above are not limited to use in an automotive acoustic reproducing apparatus, but can be suitably applied to a television receiver in which loudspeakers of left- and right-channels are narrowly spaced. In this case, signal processing for the laterally asymmetric sound field correction and the sound field expansion control may be executed in the receiver. Alternatively, the signal processing may be executed at a broadcasting station, so that the processed acoustic signals are transmitted to the individual receivers.

Further, acoustic signals of fundamental sounds from the signal processing unit 14 or **14*b* and acoustic signals of effective sounds from the signal processing unit 16 or 16*b*** may be converted into analog acoustic signals after being added to each other in the form of digital signals.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed:

1. An apparatus for expanding a stereophonic sound field produced by at least two loudspeakers disposed asymmetrically in front of a listener, said apparatus comprising:

a right and a left sound input signal;

a plurality of first circuits including phase shifting means and attenuating means;

a filter for filtering signals of different frequency bands interposed before the plurality of said first circuits a second circuit including variable level adjusting means; and, a delay circuit for delaying the right and left sound input signals to obtain respective delayed right and left sound input signals, respectively;

wherein said first circuits produce a right and a left crosstalk signal from the right and left sound input signals by phase shifting using the phase shifting means and by level correction using the attenuating means, and expand and symmetrize the sound field with respect to the listener by admixing the right and left crosstalk signals to the delayed left and right sound input signals, respectively, wherein the frequency range of the right and left input signals is subdivided into plural partial bands so as to obtain the crosstalk signals, and wherein said second circuit produces a right and a left crosstalk adjustment signal from the right and left sound input signals by level adjustment using the variable level adjusting means, and facilitates the adjustment of sound field expansion for the listener by admixing the right and left crosstalk adjustment signals to the delayed left and right sound input signals, respectively.

2. An apparatus for expanding a stereophonic sound field produced by at least two loudspeakers disposed asymmetrically in front of a listener, said apparatus comprising:

a right and a left sound input signal;

a first circuit including phase shifting means and attenuating means;

a second circuit including variable level adjusting means;

a filter for filtering signals of the frequency band of a medium sound range located before the second circuit; and a delay circuit for delaying the right and left sound input signals to obtain respective delayed right and left sound input signals, respectively;

wherein said first circuit produces a right and a left crosstalk signal from the right and left sound input signals by phase shifting using the phase shifting means and by level correction using the attenuating means, and expands and symmetrizes the sound field with respect to the listener by a mixing the right and left crosstalk signals to the delayed left and right sound input signals, respectively, wherein said second circuit produces a right and a left crosstalk adjustment signal from the right and left sound input signals by level adjustment using the variable level adjusting means, and facilitates the adjustment of sound field expansion for the listener by admixing the right and left crosstalk adjustment signals to the delayed left and right sound input signals, respectively, and wherein a band width of the crosstalk adjustment signals is limited to the frequency band of the medium sound range.

3. An apparatus for expanding a stereophonic sound field produced by at least two loudspeakers disposed asymmetrically in front of a listener, said apparatus comprising:

a right and a left sound input signal;

a first circuit including phase shifting means and attenuating means;

a second circuit including variable level adjusting means; and a third circuit including delay means and coefficient means, wherein said third circuit produces a right and a left reflected sound signal from the right and left sound input signals, respectively, by delay using the delay means and level correction using the coefficient means, wherein said first circuit produces at least one of a) a first set of right and a left crosstalk signal from the right and left sound input signals by phase shifting using the phase shifting means and by level correction using the attenuating means, and b) a second set of right and left crosstalk signals from the right and left reflected sound signals by phase shifting using the phase shifting means and by level correcting using the attenuating means, and expands and symmetrizes the sound field with respect to the listener by admixing at least one of c) the first set of right and left crosstalk signals to the left and right sound input signals, respectively, and d) by admixing the second set of right and left crosstalk signals to the left and right reflected sound signals, respectively, and wherein said second circuit produces at least one of e) a first set of right and a left crosstalk adjustment signals from the right and left sound input signals by level adjustment using the variable level adjusting means, and f) a second set of right and left crosstalk adjustment signals from the right and left reflected sound signals by level adjustment using the variable level adjusting means, and facilitates the adjustment of sound field expansion for the listener by admixing at least one of g) the first set of right and left crosstalk adjustment signals to the left and right sound input signals, respectively, and h) the second set of right and left crosstalk adjustment signals to the left and right reflected sound signals, respectively.

4. An apparatus as claimed in claim 3, comprising a plurality of said first circuits, and a filter for filtering signals of different frequency bands interposed before the plurality of said first circuits, wherein the frequency range is subdivided into plural partial bands so as to obtain the crosstalk signals.

5. An apparatus as claimed in claim 3, further comprising a filter for filtering signals of the frequency band of a medium sound range located before the second circuit, wherein the band width of the crosstalk adjustment signals is limited to the frequency band of the medium sound range.

6. An apparatus for expanding a stereophonic sound field produced by three loudspeakers disposed asymmetrically in front of a listener, said apparatus comprising:

a right and a left sound input signal;

a first circuit including phase shifting means and attenuating means; and a second circuit including variable level adjusting means, wherein said first circuit produces a right and a left crosstalk signal from the right and left sound input signals by phase shifting using the phase shifting means and by level correction using the attenuating means, and expands and symmetrizes the sound field with respect to the listener by admixing the right and left crosstalk signals to a central acoustic signal to which the right and left sound input signals have been added, and wherein said second circuit produces a right and a left crosstalk adjustment signal from the right and left sound input signals by level adjustment using the variable level adjusting means, and facilitates the adjustment of sound field expansion for the listener by admixing the right and left crosstalk adjustment signals to the central acoustic signals.

7. An apparatus as claimed in claim 6, comprising a plurality of said first circuits, and a filter for filtering signals of different frequency bands interposed before the plurality of said first circuits, wherein the frequency range is subdivided into plural partial bands so as to obtain the crosstalk signals.

8. An apparatus as claimed in claim 6, further comprising a filter for filtering signals of the frequency band of a medium sound range located before the second circuit, wherein the band width of the crosstalk adjustment signals is limited to the frequency band of the medium sound range.

9. An apparatus for expanding a stereophonic sound field produced by three loudspeakers disposed asymmetrically in front of a listener, said apparatus comprising:

a right and a left sound input signal;

a first circuit including phase shifting means and attenuating means; and a second circuit including variable level adjusting means, a third circuit including delay means and coefficient means, wherein said third circuit produces a right and a left reflected sound signal from the right and left sound input signals, respectively, by delay using the delay means and level correction using the coefficient means, wherein said first circuit produces at least either of a right and a left crosstalk signal from the right and left sound input signals, respectively, by phase shifting using the phase shifting means and by level correction using the attenuating means, or a right and a left second crosstalk signal from the right and left reflected sound signals, respectively, and expands and symmetrizes the sound field with respect to the listener by admixing at least one of the first and second crosstalk signals to a central sound signal to which the right and left sound input signals have been added, or to a central reflected sound signal to which the right and left reflected sound signals have been added, and wherein said second circuit produces at least either of the right and left crosstalk signals from the right and left sound input signals, respectively, by phase shifting using the phase shifting means and by level correction using the attenuating means, or the right and left second crosstalk signals from the right and left reflected sound signals, respectively, by level adjustment using the variable level adjusting means, and facilitates the adjustment of sound field expansion for the listener by admixing at least one of the right and left crosstalk adjustment signals and the right and left second crosstalk adjustment signals to the central sound signal or the central reflected sound signal.

10. An apparatus as claimed in claim 9, comprising a plurality of said first circuits, and a filter for filtering signals of different frequency bands interposed before the plurality of said first circuits, wherein the frequency range is subdivided into plural partial bands so as to obtain the crosstalk signals.

11. An apparatus as claimed in claim 9, further comprising a filter for filtering signals of the frequency band of a medium sound range located before the second circuit, wherein the band width of the crosstalk adjustment signals is limited to the frequency band of the medium sound range.

12. An apparatus as claimed in claim 3, wherein said first circuit comprises a fourth circuit and a fifth circuit; the fourth circuit produces the first set of right and left crosstalk signals from the right and left sound input signals, and expands and symmetrizes the sound field with respect to the listener by admixing the first set of right and left crosstalk signals to the left and right sound input signals, respectively; and the fifth circuit produces the second set of right and left crosstalk signals from the right and left reflected sound signals, and expands and symmetrizes the sound field with respect to the listener by admixing the second set of right and left crosstalk signals to the left and right reflected sound signals, respectively.

13. An apparatus as claimed in claim 3, wherein said second circuit comprises a fourth circuit and a fifth circuit; the fourth circuit produces the first set of right and left crosstalk adjustment signals from the right and left sound input signals, and facilitates the adjustment of sound field expansion for the listener by admixing the first set of right and left crosstalk adjustment signals to the left and right sound input signals, respectively; and the fifth circuit produces the second set of right and left crosstalk adjustment signals from the right and left reflected sound signals, and facilitates the adjustment of sound field expansion for the listener by admixing the second set of right and left crosstalk adjustment signals to the left and right reflected sound signals, respectively.

* * * * *